US007880678B2

(12) United States Patent
Degner et al.

(10) Patent No.: US 7,880,678 B2
(45) Date of Patent: Feb. 1, 2011

(54) REMOVABLE ANTENNAS FOR ELECTRONIC DEVICES

(75) Inventors: Brett William Degner, Menlo Park, CA (US); Chris Ligtenberg, San Carlos, CA (US); Bartley K. Andre, Menlo Park, CA (US); Douglas Blake Kough, San Jose, CA (US)

(73) Assignee: Apple Inc., Cupertino, CA (US)

( * ) Notice: Subject to any disclaimer, the term of this patent is extended or adjusted under 35 U.S.C. 154(b) by 344 days.

(21) Appl. No.: 12/061,176

(22) Filed: Apr. 2, 2008

(65) Prior Publication Data

US 2009/0251372 A1 Oct. 8, 2009

(51) Int. Cl.
*H01Q 1/24* (2006.01)

(52) U.S. Cl. ..... 343/702; 343/906

(58) Field of Classification Search ..... 342/702, 342/906, 882

See application file for complete search history.

(56) References Cited

U.S. PATENT DOCUMENTS 5,913,174 A 6/1999 Casarez et al.
5,983,119 A 11/1999 Martin et al.
6,259,409 B1 7/2001 Fulton et al.
6,380,897 B1 * 4/2002 Shaw et al. ..... 343/702
2001/0044320 A1 * 11/2001 Ono et al. ..... 455/550
2005/0093762 A1 5/2005 Pick
2006/0279473 A1 * 12/2006 Yu ..... 343/906

* cited by examiner

*Primary Examiner*—HoangAnh T Le
(74) *Attorney, Agent, or Firm*—Treyz Law Group; David C. Kellogg; G. Victor Treyz

(57) ABSTRACT

A removable antenna is provided for an electronic device such as a laptop computer. An antenna resonating element is mounted within the antenna. Magnetic coupling structures are used to magnetically attach the antenna to the electronic device. The magnetic coupling structures couple the antenna resonating element to circuitry in the electronic device. The electronic device may have an antenna receptacle that holds the antenna in a stowed position and allows the antenna to extend to an extended position. A user may extend the antenna by sliding the antenna or by rotating the antenna to its extended position. The coupling structures may allow the antenna to break away from the electronic device without damage.

20 Claims, 21 Drawing Sheets

REMOVABLE ANTENNAS FOR ELECTRONIC DEVICES

BACKGROUND

This invention relates to antennas, and more particularly, to removable antennas for electronic devices.

It may be desirable to include wireless communications capabilities in an electronic device. Electronic devices may use wireless communications to communicate with wireless base stations. For example, electronic devices may communicate using the Wi-Fi® (IEEE 802.11) bands at 2.4 GHz and 5.0 GHz and the Bluetooth® band at 2.4 GHz. Electronic devices may also use other types of communications links. For example, electronic devices such as cellular telephones may communicate using cellular telephone bands at 850 MHz, 900 MHz, 1800 MHz, and 1900 MHz (e.g., the main Global System for Mobile Communications or GSM cellular telephone bands). Communications are also possible in data service bands such as the 3G data communications band at 2100 MHz (commonly referred to as UMTS or Universal Mobile Telecommunications System).

Many popular housing materials such as metal have a high conductivity. This poses challenges when designing an antenna for an electronic device with this type of housing. An internal antenna would be shielded by a high-conductivity housing, so internal antenna designs are often not considered practical in electronic devices with conductive cases. On the other hand, external antenna designs that protrude excessively from a device housing may have an unattractive appearance. External antenna designs may also be susceptible to damage.

It would therefore be desirable to be able to provide a satisfactory antenna for an electronic device with a conductive case.

SUMMARY

In accordance with an embodiment of the present invention, removable antennas for electronic devices are provided. A removable antenna may be magnetically coupled to an electronic device. The antenna and the electronic device may have corresponding coupling structures. The coupling structures may be magnetic and/or ferromagnetic and may be integrated into the structure of the antenna and the structure of the electronic device. The coupling structures may provide a magnetic force that magnetically couples the antenna to the electronic device. With one suitable arrangement, the coupling structures may be formed in distinct portions of the antenna and the electronic device. Because the antenna is magnetically coupled to the electronic device, the antenna may be removed from the electronic device without damaging the antenna, the electronic device, or the coupling structures. This helps to prevent damage in the event that the antenna is accidently dislodged.

The antenna need not be extendable. In embodiments where the antenna is not extendable, the coupling structures on the electronic device may be configured to blend in with surrounding portions of the electronic device. Non-extendable removable antenna arrangements may allow a user of the electronic device to easily swap antennas of varying shapes and sizes.

If desired, the antenna may be extendable. The electronic device may have a conductive housing. The antenna may have improved transmission and reception efficiencies when the antenna is placed in an extended position away from the conductive housing. In the antenna's extended position, the antenna's performance may be enhanced by the increase in separation (e.g., compared to a stowed position) between an antenna resonating element in the antenna and the ground plane of the metal housing of the electronic device. The antenna resonating element in the antenna may be formed from any suitable antenna design. For example, the antenna resonating element may be formed from a flex circuit containing a strip of conductor, a piece of stamped metal foil, a length of wire, etc.

In addition to physically coupling the antenna and the electronic device together, the coupling structures may couple the antenna resonating element structures in the antenna to a transceiver in the electronic device through a communications path. The coupling of the antenna resonating element to the communications path may be magnetic, so that no damage will result when the coupling structures are separated. The coupling structures may be also conductive. Conductive coupling structures may be used to electrically connect the communications path and the antenna resonating element while physically attracting the antenna to the electronic device using the magnetic properties of the coupling structures.

A removable and extendable antenna may be configured to extend by rotating about an axis. For example, an antenna may be extended by rotating the antenna about an axis centered near one of the ends of the antenna.

A removable and extendable antenna may also be configured to extend by reciprocating along its length. For example, an antenna may extend by sliding lengthwise from its stowed position to its extended position.

Coupling structures may provide a magnetic force that helps guide an antenna from its stowed position to its extended position. For example, in embodiments in which the antenna is configured to extend or retract by reciprocating along its length, the coupling structures may help to guide the antenna in a straight line along the length of the antenna.

The coupling structures may provide feedback to a user of the electronic device when the antenna is in its extended or its stowed position. For example, the coupling structures may be configured to make a noise when the antenna enters its extended or its stowed position or may be configured to serve as a detent.

A removable and extendable antenna may be configured to blend in with surrounding portions of an electronic device when the antenna is in a stowed position. For example, the antenna may have an outer surface that is appropriately colored, textured, and shaped such that the antenna in its stowed position appears as a nearly seamless or unobtrusive portion of the electronic device. Some or all of the coupling structures may contribute to a magnetic force that aligns the antenna with the electronic device in its stowed state such that the antenna properly blends in with the surrounding portions of the electronic device.

Signals may be conveyed from an antenna structure or other removable device and an electronic device using magnetic coupling structures. The signals that are conveyed through the magnetic coupling structures in this way may include DC signals such as signals associated with a sensor or signals associated with the presence or absence of an antenna resonating element or other device.

Further features of the invention, its nature and various advantages will be more apparent from the accompanying drawings and the following detailed description.

DETAILED DESCRIPTION

The present invention relates generally to antennas, and more particularly, to removable antennas for wireless electronic devices.

The wireless electronic devices may be any suitable electronic devices. As an example, the wireless electronic devices may be desktop computers or other computer equipment. The wireless electronic devices may also be portable electronic devices such as laptop computers or small portable computers of the type that are sometimes referred to as ultraportables. With one suitable arrangement, the portable electronic devices may be handheld electronic devices.

Examples of portable and handheld electronic devices include cellular telephones, media players with wireless communications capabilities, handheld computers (also sometimes called personal digital assistants), remote controls, global positioning system (GPS) devices, and handheld gaming devices. The devices may also be hybrid devices that combine the functionality of multiple conventional devices. Examples of hybrid devices include a cellular telephone that includes media player functionality, a gaming device that includes a wireless communications capability, a cellular telephone that includes game and email functions, and a handheld device that receives email, supports mobile telephone calls, has music player functionality and supports web browsing. These are merely illustrative examples.

Figure 1:
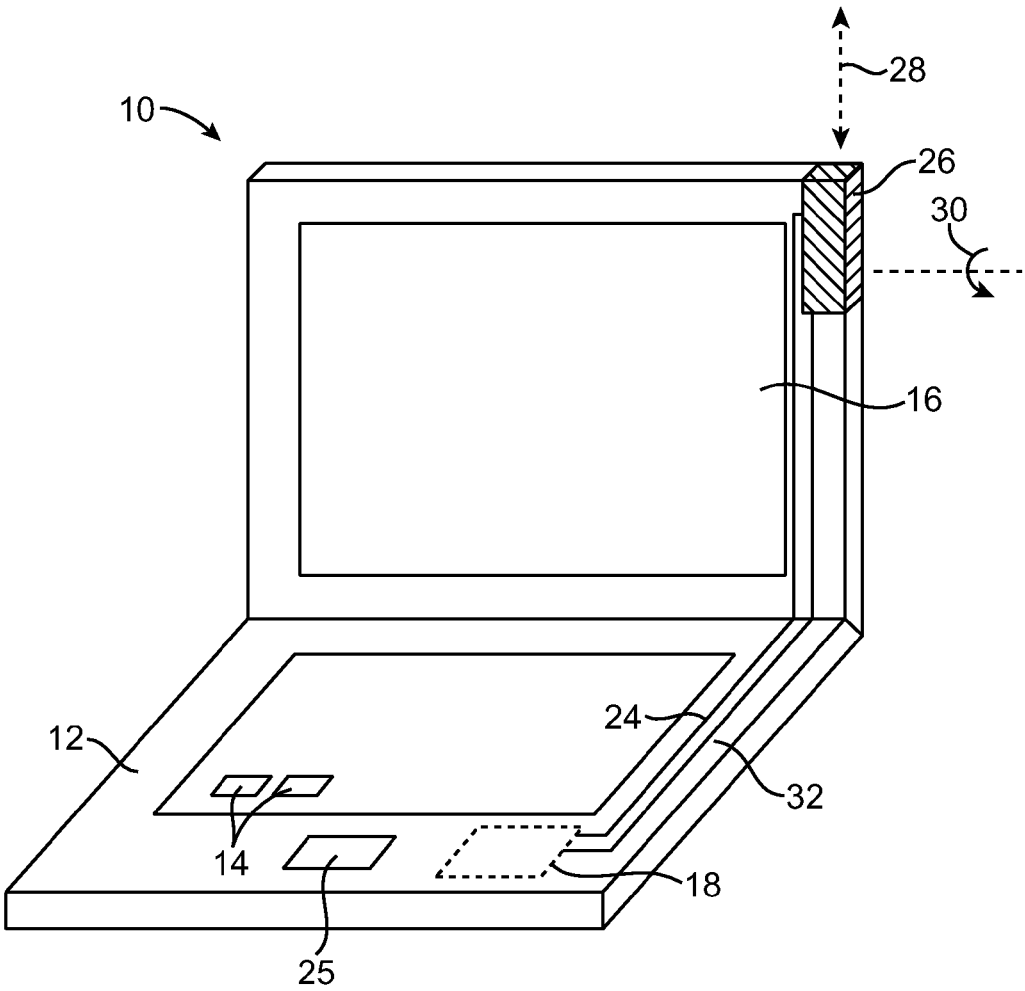
FIG. 1 is a perspective view of an illustrative electronic device and an illustrative extendable, removable antenna in a stowed state in accordance with an embodiment of the present invention.

An illustrative electronic device such as a portable electronic device in accordance with an embodiment of the present invention is shown in FIG. 1. Device 10 may be any suitable electronic device. As an example, device 10 may be a laptop computer.

Device 10 may handle communications over one or more communications bands. For example, wireless communications circuitry in device 10 may be used to handle cellular telephone communications in one or more frequency bands and data communications in one or more communications bands. Typical data communications bands that may be handled by the wireless communications circuitry in device 10 include the 2.4 GHz band that is sometimes used for Wi-Fi® (IEEE 802.11) and Bluetooth® communications, the 5.0 GHz band that is sometimes used for Wi-Fi communications, the 1575 MHz Global Positioning System band, and 3G data bands (e.g., the UMTS band at 1920-2170). These bands may be covered by using single band and multiband antennas. For example, cellular telephone communications can be handled using a multiband cellular telephone antenna and local area network data communications can be handled using a multiband wireless local area network antenna. As another example, device 10 may have a single multiband antenna for handling communications in two or more data bands (e.g., at 2.4 GHz and at 5.0 GHz).

Device 10 may have housing 12. Housing 12, which is sometimes referred to as a case, may be formed of any suitable materials including plastic, glass, ceramics, metal, other suitable materials, or a combinations of these materials.

Housing 12 or portions of housing 12 may also be formed from conductive materials such as metal. An illustrative metal housing material that may be used is anodized aluminum. Aluminum is relatively light in weight and, when anodized, has an attractive insulating and scratch-resistance surface. If desired, other metals can be used for the housing of device 10, such as stainless steel, magnesium, titanium, alloys of these metals and other metals, etc. In scenarios in which housing 12 is formed from metal elements, one or more of the metal elements may be used as part of the antenna in device 10. For example, metal portions of housing 12 and metal components in housing 12 may be shorted together to form a ground plane in device 10 or to expand a ground plane structure that is formed from a planar circuit structure such as a printed circuit board structures (e.g., a printer circuit board structure used in forming antenna structures for device 10).

Device 10 may have one or more buttons such as buttons 14. Buttons 14 may be formed on any suitable surface of device 10. In the example of FIG. 1, buttons 14 have been formed on the top surface of device 10. As an example, buttons 14 may form a keyboard on a laptop computer.

If desired, device 10 may have a display such as display 16. Display 16 may be a liquid crystal diode (LCD) display, an organic light emitting diode (OLED) display, a plasma display, or any other suitable display. The outermost surface of display 16 may be formed from one or more plastic or glass layers. If desired, touch screen functionality may be integrated into display 16. Device 10 may also have a separate touch pad device such as touch pad 25. An advantage of integrating a touch screen into display 16 to make display 16 touch sensitive is that this type of arrangement can save space and reduce visual clutter. Buttons 14 may, if desired, be arranged adjacent to display 16. With this type of arrangement, the buttons may be aligned with on-screen options that are presented on display 16. A user may press a desired button to select a corresponding one of the displayed options.

Device 10 may have circuitry 18. Circuitry 18 may include storage, processing circuitry, and input-output components. Wireless transceiver circuitry in circuitry 18 may be used to transmit and receive radio-frequency (RF) signals. Communications paths such as coaxial communications paths and microstrip communications paths may be used to convey radio-frequency signals between transceiver circuitry and antenna structures in device 10. As shown in FIG. 1, for example, communications path 24 may be used to convey signals between antenna structure 26 and circuitry 18. Communications path 24 may be, for example, a coaxial cable that is connected between an RF transceiver (sometimes called a radio) and a multiband antenna. Antenna structures such as antenna structure 26 may be located adjacent to a corner of device 10 as shown in FIG. 1 or in other suitable locations. For example, antenna structure 26 may be located along a top edge of display 16, along any edge of device 10, or may be located in a suitable portion of any planar surface of device 10.

Antenna structure 26 may be removable and extendable. Antenna structure 26 may be magnetically coupled to device 10 to allow the antenna structure to be removed without damaging antenna structure 26 or device 10. The use of magnetic coupling may facilitate easy replacement of antenna structure 26 and may facilitate break away of the antenna structure when a force is applied that could otherwise damage the antenna structure.

Antenna structure 26 may translate or rotate from a stowed position (e.g., the position shown in FIG. 1) into an extended position. The extended position of antenna structure 26 may be used to increase the efficiency of signal reception and transmission. For example, the extended position of antenna structure 26 may enhance wireless communications functionality by increasing the separation between the ground plane of device 10 and antenna resonating elements in antenna structure 26 relative to the separation between the ground plane and the antenna resonating elements in the stowed position.

Antenna structure 26 may be configured such that in the stowed position the antenna structure is flush, or nearly flush, with the surrounding portions of device 10. The stowed position of the antenna structure may improve the visual appearance of device 10. For example, when the antenna structure is in the stowed position, the antenna structure may blend in with the surrounding portions of device 10 and thereby reduce visual clutter. In the stowed position, the antenna structure is also generally less vulnerable to accidental detachment.

As illustrated in FIG. 1, antenna structure 26 may reciprocate along its longitudinal axis 28. Antenna structure 26 may reciprocate along longitudinal axis 28 when transitioning between its stowed state and its extended state.

In another embodiment, antenna structure 26 may rotate about an axis such as axis 30. Antenna structure 26 may rotate about axis 30 when transitioning between its stowed state and its extended state.

Device 10 may have sensors to determine whether antenna structure 26 is attached or detached and to determine whether antenna structure 26 is in an extended or stowed position. Communications path 32 may be used to convey signals between these sensors and circuitry 18. Communications path 32 may be implemented using any suitable cable or wires.

Figure 2:
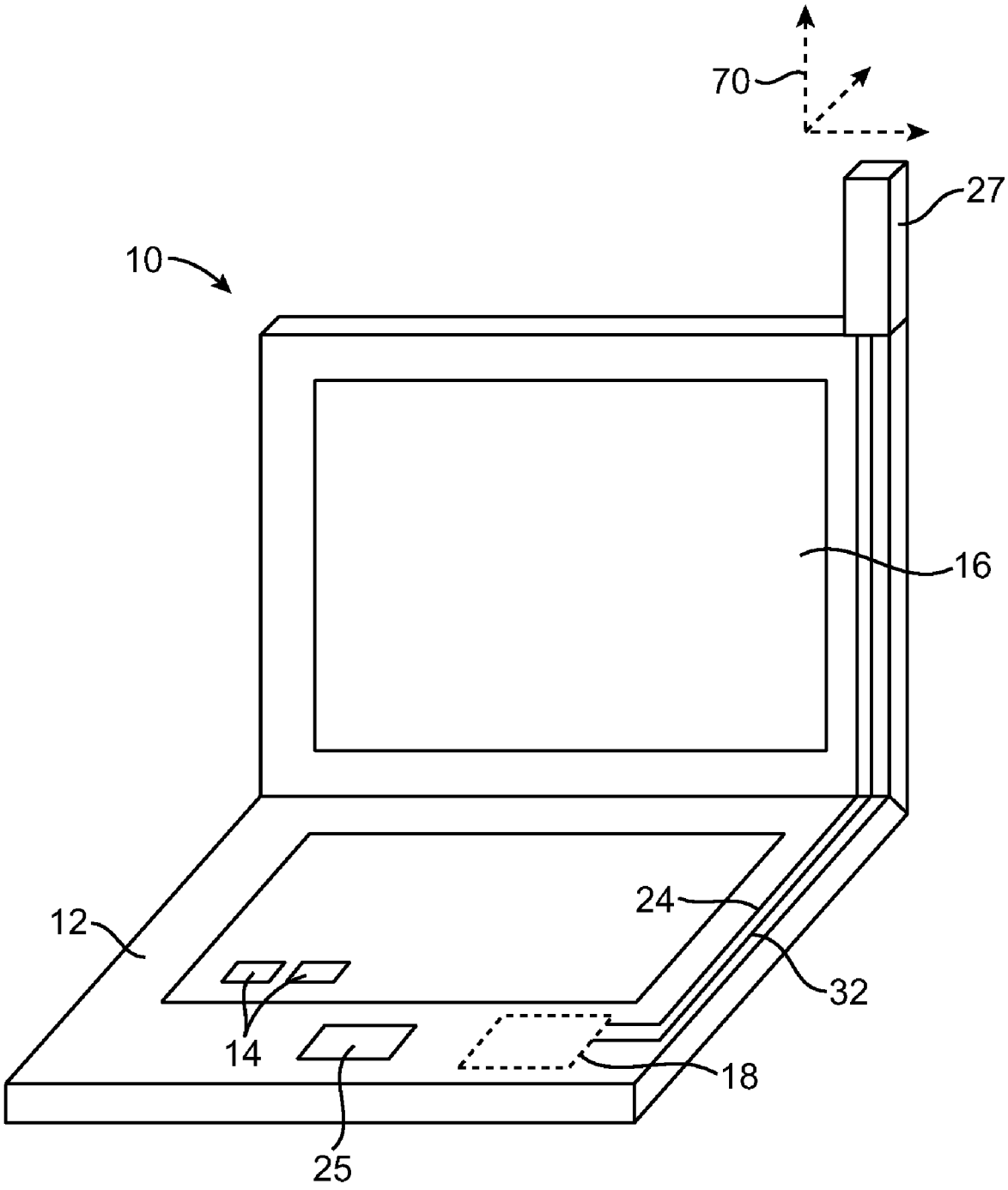
FIG. 2 is a perspective view of an illustrative electronic device and an illustrative removable antenna in an attached state in accordance with an embodiment of the present invention.

As shown in FIG. 2, device 10 may have an unextendable removable antenna structure such as antenna structure 27 that does not reciprocate or rotate relative to housing 12. Unextendable removable antenna structure 27 may be magnetically coupled to device 10 to allow the antenna structure to be removed without damaging antenna structure 27 or device 10. Antenna structure 27 may be mounted on device 10 at any suitable attachment point. For example, antenna structure 27 may be attached to the top or side edge of device 10. As shown by dotted lines 70, antenna structure 27 may be removed in any desired direction excluding directions that would require the antenna structure to pass through device 10. A removable antenna structure such as antenna structure 27 may allow a user to utilize antenna structures of any suitable size or shape including those that may not have blended with surrounding portions of device 10 while still retaining the benefits of a magnetic coupling that allows the antenna structure to break away undamaged.

Figure 3:
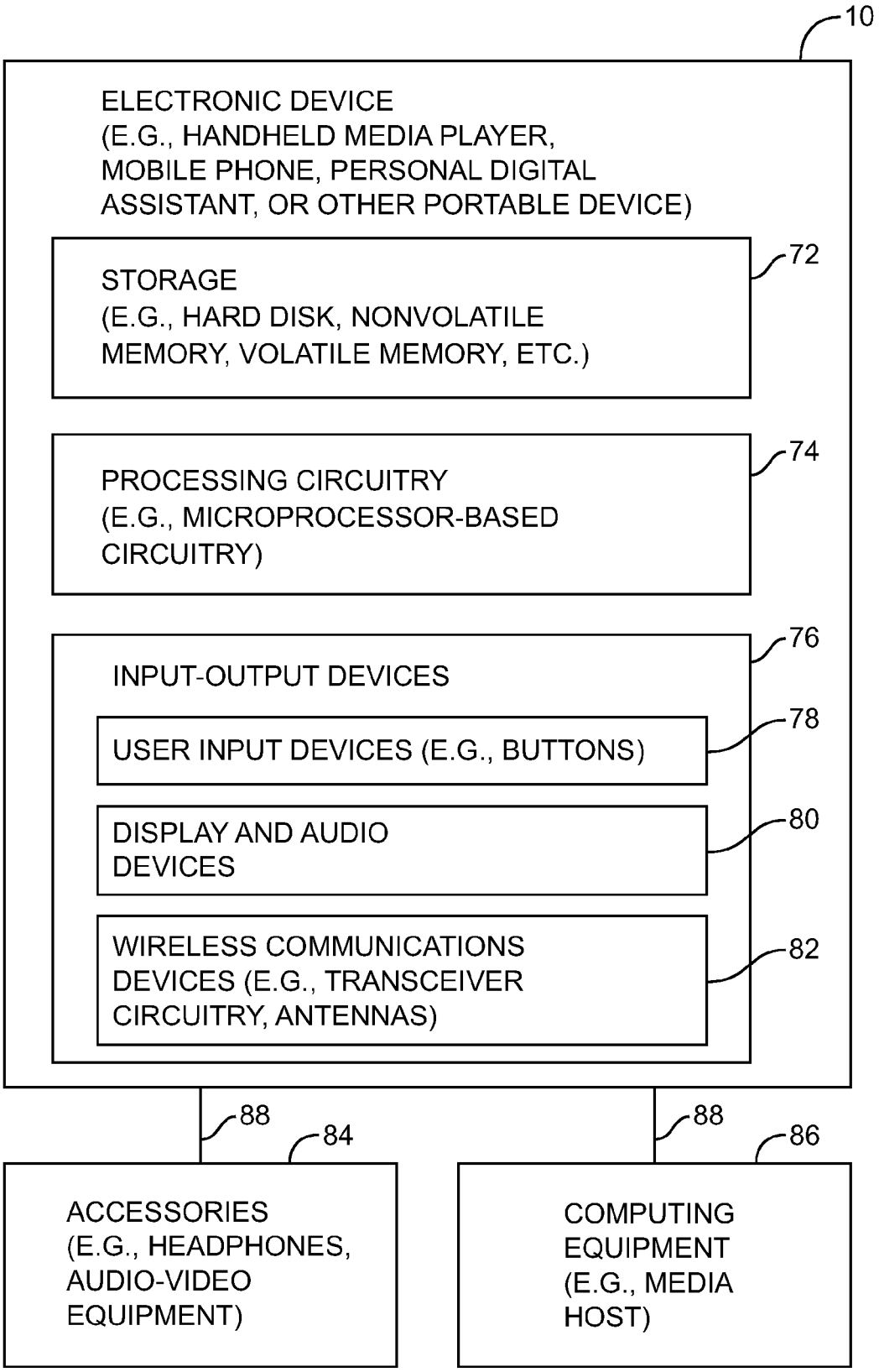
FIG. 3 is a schematic diagram of an illustrative electronic device in accordance with an embodiment of the present invention.

A schematic diagram of an embodiment of electronic device 10 is shown in FIG. 3. Electronic device 10 may be a notebook computer, a tablet computer, an ultraportable computer, a mobile telephone, a mobile telephone with media player capabilities, a handheld computer, a remote control, a game player, a global positioning system (GPS) device, a combination of such devices, or any other suitable portable or handheld electronic device.

As shown in FIG. 3, electronic device 10 may include storage 72. Storage 72 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 74 may be used to control the operation of device 10. Processing circuitry 74 may be based on a processor such as a microprocessor and other suitable integrated circuits. With one suitable arrangement, processing circuitry 74 and storage 72 are used to run software on device 10, such as internet browsing applications, voice-over-internet-protocol (VOIP) telephone call applications, email applications, media playback applications, operating system functions, etc. Processing circuitry 74 and storage 72 may be used in implementing suitable communications protocols. Communications protocols that may be implemented using processing circuitry 74 and storage 72 include internet protocols, wireless local area network protocols (e.g., IEEE 802.11 protocols—sometimes referred to as Wi-Fi®), protocols for other short-range wireless communications links such as the Bluetooth® protocol, protocols for handling 3G data services such as UMTS, cellular telephone communications protocols, etc.

Input-output devices 76 may be used to allow data to be supplied to device 10 and to allow data to be provided from device 10 to external devices. Display screen 16, keys 14, and touchpad 25 of FIG. 1 are examples of input-output devices 76.

Input-output devices 76 may include user input-output devices 78 such as buttons, touch screens, joysticks, click wheels, scrolling wheels, touch pads, key pads, keyboards, microphones, cameras, speakers, tone generators, vibrating elements, etc. A user can control the operation of device 10 by supplying commands though user input devices 78.

Display and audio devices 80 may include liquid-crystal display (LCD) screens or other screens, light-emitting diodes (LEDs), and other components that present visual information and status data. Display and audio devices 80 may also include audio equipment such as speakers and other devices for creating sound. Display and audio devices 80 may contain audio-video interface equipment such as jacks and other connectors for external headphones and monitors.

Wireless communications devices 82 may include communications circuitry such as radio-frequency (RF) transceiver circuitry formed from one or more integrated circuits, power amplifier circuitry, passive RF components, one or more antennas (e.g., antenna structures such as antenna structure 26 of FIG. 1), and other and other circuitry for handling RF wireless signals. Wireless signals can also be sent using light (e.g., using infrared communications).

Device 10 can communicate with external devices such as accessories 84 and computing equipment 86, as shown by paths 88. Paths 88 may include wired and wireless paths. Accessories 84 may include headphones (e.g., a wireless cellular headset or audio headphones) and audio-video equipment (e.g., wireless speakers, a game controller, or other equipment that receives and play audio and video content).

Computing equipment 86 may be any suitable computer. With one suitable arrangement, computing equipment 86 is a computer that has an associated wireless access point or an internal or external wireless card that establishes a wireless connection with device 10. The computer may be a server (e.g., an internet server), a local area network computer with or without internet access, a user's own personal computer, a peer device (e.g., another electronic device 10), or any other suitable computing equipment.

The antenna structures and wireless communications devices of device 10 may support communications over any suitable wireless communications bands. For example, wireless communications devices 82 may be used to cover communications frequency bands such as the cellular telephone bands at 850 MHz, 900 MHz, 1800 MHz, and 1900 MHz, data service bands such as the 3G data communications band at 2100 MHz (commonly referred to as UMTS or Universal Mobile Telecommunications System), Wi-Fi® (IEEE 802.11) bands (also sometimes referred to as wireless local area network or WLAN bands), the Bluetooth® band at 2.4 GHz, and the global positioning system (GPS) band at 1575 MHz. Wi-Fi bands that may be supported include the 2.4 GHz band and the 5.0 GHz bands. The 2.4 GHz Wi-Fi band extends from 2.412 to 2.484 GHz. Commonly-used channels in the 5.0 GHz Wi-Fi band extend from 5.15-5.85 GHz, so the 5.0 GHz band is sometimes referred to by the 5.4 GHz approximate center frequency for this range (i.e., these communications frequencies are sometimes referred to as making up a 5.4 GHz communications band). Device 10 can cover these communications bands and/or other suitable communications bands with proper configuration of the antenna structures in wireless communications circuitry 82).

Figure 4:
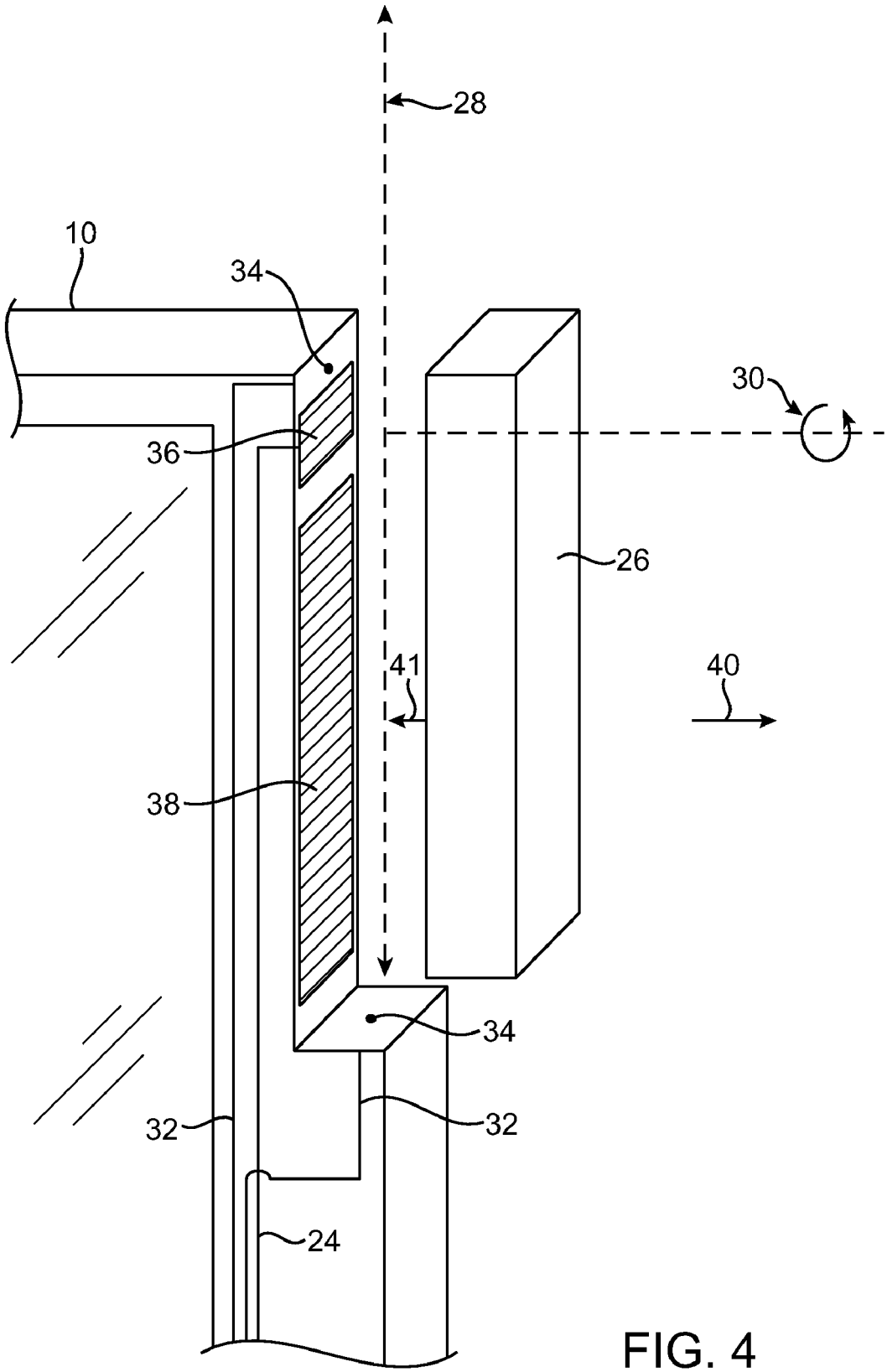
FIG. 4 is an exploded perspective view of an illustrative electronic device and an illustrative extendable, removable antenna in accordance with an embodiment of the present invention.

As shown in FIG. 4, device 10 may have a removable, extendable antenna structure such as antenna structure 26. Antenna structure 26 may be magnetically coupled to device 10 to allow the antenna structure to be intentionally or accidently removed without damaging antenna structure 26 or device 10.

In the FIG. 4 example, antenna structure 26 is shown near device 10 in approximately its stowed state. The actual position of the antenna structure in its stowed state is approximately that of line 28. If the antenna structure were to be moved into alignment along line 28 by moving the antenna structure in the direction of arrow 41, the antenna structure would be in the approximate position of its stowed state.

Antenna structure 26 may be extended from a stowed position that may maximize the aesthetics of device 10 to an extended position that may maximize the performance and efficiency of the antenna structure by reciprocating along its longitudinal axis (e.g., axis 28). During reciprocation along axis 28, antenna structure 26 may be magnetically coupled to device 10. In another example, antenna structure 26 may rotate about an axis such as the axis of line 30 when transitioning between its stowed position and its extended position. Magnetic coupling may be used to hold antenna structure 26 in place on device 10 during rotational movement.

Antenna structure 26 may be configured to break away from device 10 to prevent damage to the antenna structure and device 10. For example, if antenna structure 26 translates too far along line 28, antenna structure 26 may break away from device 10. Antenna structure 26 may also break away when a force acts upon the antenna structure to either push or pull the antenna structure away from device 10. For example, if the antenna structure is struck in direction 40, the magnetic force that couples device 10 and antenna structure 26 may give way before damage occurs to the antenna structure or the device.

Optional sensors 34 and communications paths 32 may be used by device 10 to determine whether antenna structure 26 is attached and/or whether the antenna structure is in a stowed state or in an extended state. Sensors 34 may send position signals to circuitry 18 indicating when antenna structure 26 is in position to transmit and receive radio signals (i.e., when the antenna structure is in its extended position). Circuitry 18 may use position signals from sensors 34 to enable or disable wireless communications devices 82 that transmit and receive radio-frequency signals using an antenna resonating element in antenna structure 26.

Antenna structure 26 may be mechanically and/or electrically coupled to device 10 using coupling structures such as coupling structures 36 and 38 on device 10 and corresponding coupling structures on antenna structure 26. Coupling structure 36 and a corresponding coupling structure in antenna structure 26 couple communications path 24 to an antenna resonating element in antenna structure 26. Coupling structures (or portions of coupling structure) may be made of one or more magnetic elements (magnets) and/or one or more ferromagnetic elements (e.g., iron bars). Magnetic or ferromagnetic portions of coupling structures may produce a magnetic force that couples antenna structure 26 to device 10.

An elongated coupling structure such as coupling structure 38 may be used to produce a magnetic force that couples antenna structure 26 to device 10 as structures 26 moves relative to device 10. Coupling structure 38 may, for example, be configured to guide antenna structure 26 along longitudinal axis 28 when the antenna structure is extended or retracted by reciprocating along longitudinal axis 28.

Figure 5:
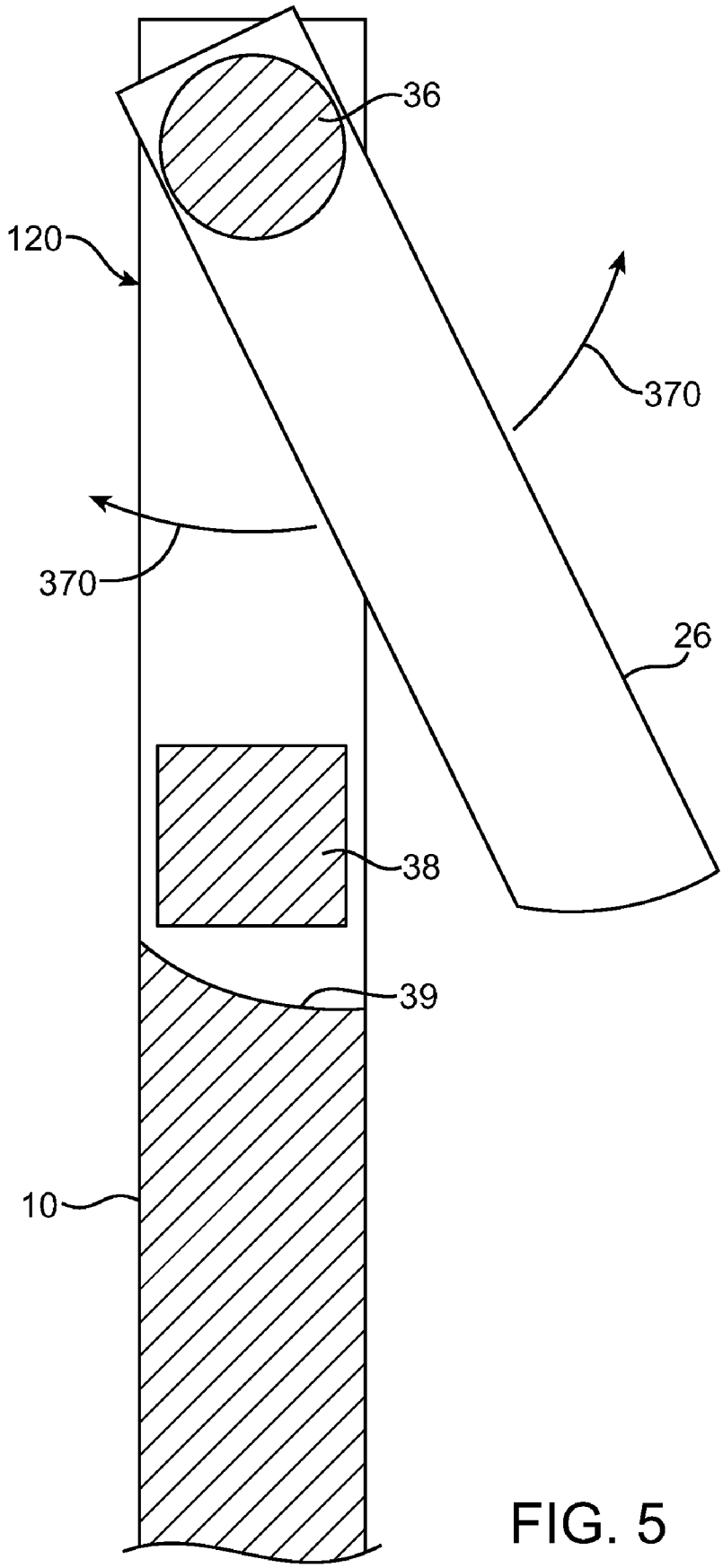
FIG. 5 is a cross-sectional side view of an illustrative antenna receptacle in an electronic device and an illustrative extendable, removable antenna in accordance with an embodiment of the present invention.

An illustrative antenna receptacle that may be a part of an electronic device such as device 10 is shown in FIG. 5. Antenna receptacle 120 may be formed from portions of device 10 that surround antenna structure 26 when antenna structure 26 is in its stowed position. The antenna receptacle of FIG. 5 may have a curved edge such as edge 39 that maintains aesthetic features of antenna structure 26 and device 10 when the antenna structure is in a stowed state. Edge 39 may allow the antenna structure to rotate about an axis centered on coupling structure 36 (e.g., in one of directions 370) to an extended state, or vice versa, without impinging on the edge of the antenna receptacle.

As shown in the example of FIG. 5, coupling structure 38 may be reduced in size relative to the arrangement of FIG. 4 and may serve to retain the antenna structure in correct alignment inside the antenna receptacle when the antenna structure is in its stowed state. Coupling structure 38 may provide acoustic and/or tactile feedback when the antenna structure transitions from a nearly stowed state to its stowed state. Coupling structure 38 may also provide acoustic and/or tactile feedback when the antenna structure transitions from its stowed state to a partially deployed state. Feedback on the position of antenna structure 26 may also be provided by sensing the position of antenna structure 26 using one or more position sensors (e.g., sensors 34), processing the position information from the sensors using processor 74, and providing a visual or audio signal to a user with devices 76.

Figure 6:
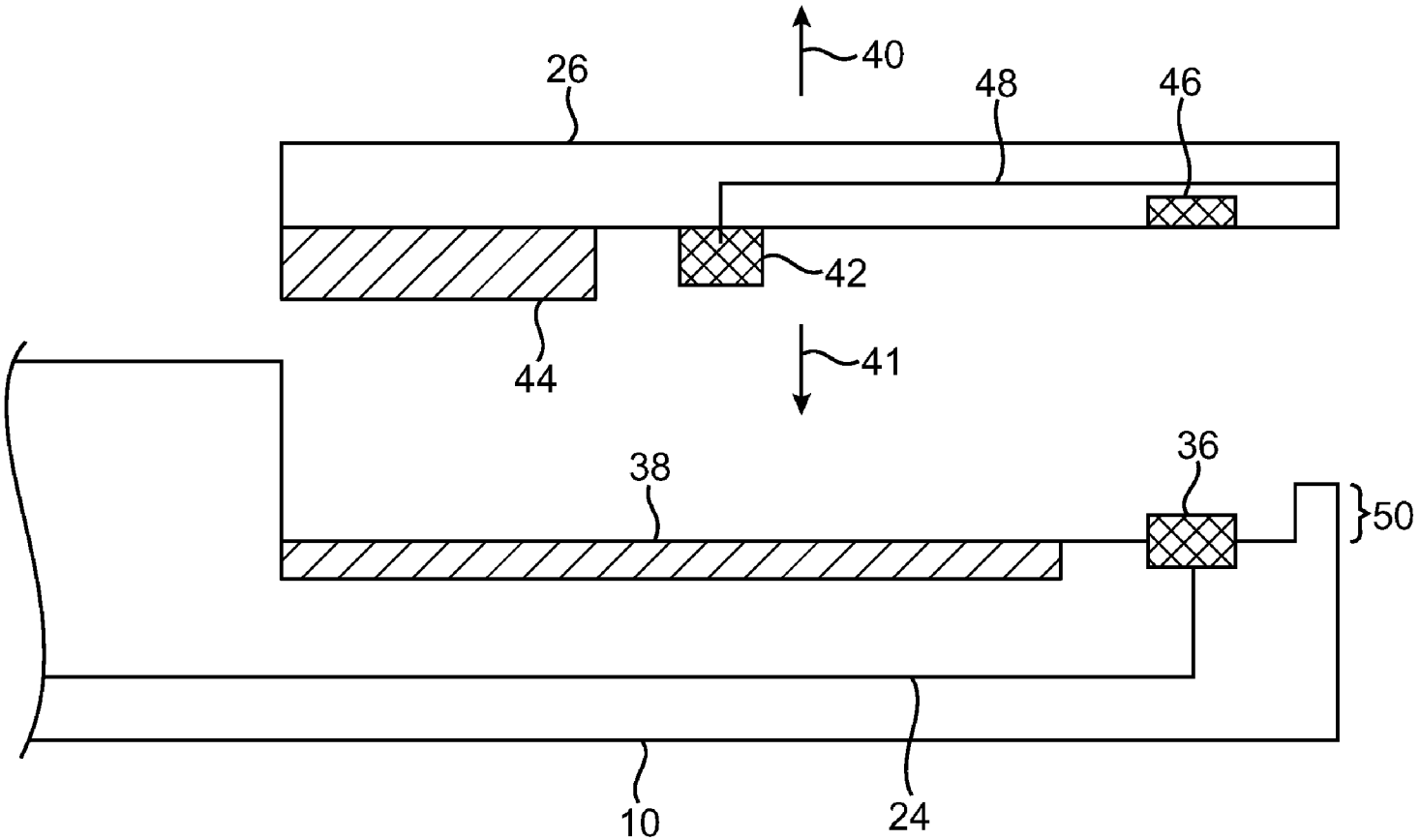
FIG. 6 is a cross-sectional side view of an illustrative extendable, removable antenna and an illustrative antenna receptacle in an electronic device in accordance with an embodiment of the present invention.

FIG. 6 shows a cross sectional view of antenna structure 26 and an antenna receptacle in device 10. The antenna structure shown in FIG. 6 is aligned as if in a stowed state but is vertically offset to facilitate the illustration of the various components of the antenna receptacle and the antenna structure. If the antenna structure were moved in direction 41, the antenna structure's magnetic coupling structures (e.g., structures 44 and 46) would mate with corresponding magnetic coupling structures in device 10 (e.g., structures 38 and 36) and the antenna structure would be in its stowed state.

Coupling structure 44 may be a tip attraction element that serves to attract the tip of antenna structure 26 to device 10 when the antenna structure is in its stowed position. The attraction of the tip of antenna structure 26 to device 10 via coupling structure 44 (and coupling structure 36) may enhance the visual appearance of antenna structure 26 in its stowed position by holding the antenna structure in its proper stowed position.

Coupling structure 42 may be a coupling structure in antenna structure 26 that couples antenna resonating element 48 to communications path 24 in device 10 when the antenna is in its extended position. Coupling structures such as structures 36, 38, 42, 44, and 46 may be made of one or more magnetic elements and/or one or more ferromagnetic elements. For example, structures 42, 44, and 46 may be magnets and structures 36 and 38 may be ferromagnetic.

In the stowed state of antenna structure 26, the antenna structure and device 10 may have a uniform and clutter-free visual appearance. Outer portions of structure 26 may be aligned with surrounding portions of device 10. Antenna structure 26 may be configured such that a force acting to move the antenna structure in direction 40 may overcome the magnetic attraction between antenna structure 26 and device 10 before damage occurs to either antenna structure 26 or device 10.

Coupling structures 36, 38, 42, 44, and 46 may be made of ferromagnetic or magnetic materials. In one embodiment, all of or portions of each of the coupling structures are made from magnetic materials. In another embodiment, some of the coupling structures are magnetic and their mating coupling structures are ferromagnetic. Coupling structures such as structures 36, 38, 42, 44, and 46 may be integrated into antenna structure 26 and/or device 10 or may be more distinct portions as shown in FIG. 6. In embodiments where the coupling structures are more integrated into antenna structure 26 and/or device 10, the coupling structures may improve the visual appearance of the antenna and device 10 by reducing visual clutter. In general, there may be any suitable number of coupling structures associated with a given device 10.

When antenna structure 26 is in its stowed state, coupling structure 36 may secure the tip of antenna structure 26 by magnetically attracting a tip attraction element such as structure 46. The attraction between structures 36 and 46 may provide tactile feedback in the form of an acoustic and/or tactile signal when the antenna structure transitions into or out of its stowed state. The attraction between structures 36 and 46 may serve to secure the tip of antenna structure 26 and thereby align the outside of antenna structure 26 with surrounding portions of device 10 and increase the aesthetic appearance of antenna structure 26 and device 10 when the antenna structure is in its stowed state.

Coupling structure 36 of FIG. 6 may couple communications path 24 through coupling structure 42 of antenna structure 26 to antenna resonating element 48. Coupling structure 42 may be configured to provide feedback to a user that coupling structures 36 and 42 have coupled or decoupled (i.e., antenna structure 26 has fully extended or started retracting from the extended position) in the form of an acoustic and/or tactile signal.

When the antenna structure is transitioning between its extended and stowed states, coupling structure 44 may help to guide antenna structure 26 along its longitudinal axis and along structure 38 which may act as a track for antenna structure 26. With one suitable arrangement, coupling structure 44 (e.g., attraction element 44) may provide the majority of the attractive force that couples antenna structure 26 to device 10 and that keeps the antenna structure aligned when it is reciprocating between its extended and stowed states.

Antenna resonating element 48 may be a part of antenna structure 26. Antenna resonating element 48 may form part of an antenna for wireless communications devices 82. Antenna resonating element 48 may be based on any suitable antenna technology. For example, antenna resonating element 48 may be a part of a dipole antenna, a horn antenna, a monopole antenna, a single band antenna, a multiband antenna, etc. With one suitable arrangement, antenna resonating element 48 serves as one pole of an antenna and a ground plane element associated with device 10 (e.g., a conductive housing 12) may serve as another pole of the antenna.

Figure 7:
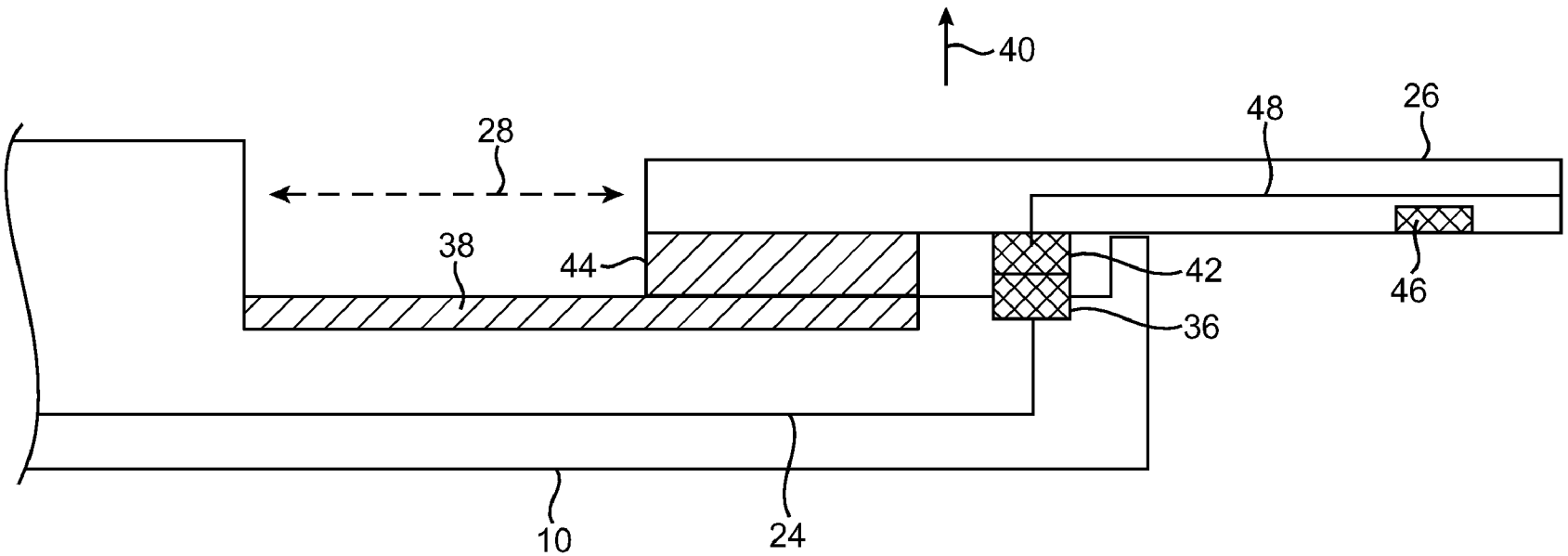
FIG. 7 is a cross-sectional side view of an illustrative extendable, removable antenna in an extended state and an illustrative antenna receptacle in an electronic device in accordance with an embodiment of the present invention.

FIG. 7 shows a cross sectional view of antenna structure 26 and an antenna receptacle in device 10. The antenna structure of FIG. 7 is shown in its extended state. In the extended state, coupling structures 36 and 42 may be coupled together and antenna resonating element 48 may be electrically coupled to communications path 24 and circuitry 18 through coupling structures 36 and 42.

Antenna structure 26 may reciprocate along its longitudinal axis 28 to transition between its extended and stowed states. In the FIG. 7 example, antenna structure 26 is shown in the extended state and may be translated in the leftward direction towards the stowed position.

Antenna structure 26 may break away from device 10 in a suitable direction such as direction 40. The magnetic structures of antenna structure 26 and/or device 10 may be configured such that the magnetic coupling releases before a force applied to push or pull structure 26 from device 10 can cause damage to either structure 26 or device 10.

Figure 8:
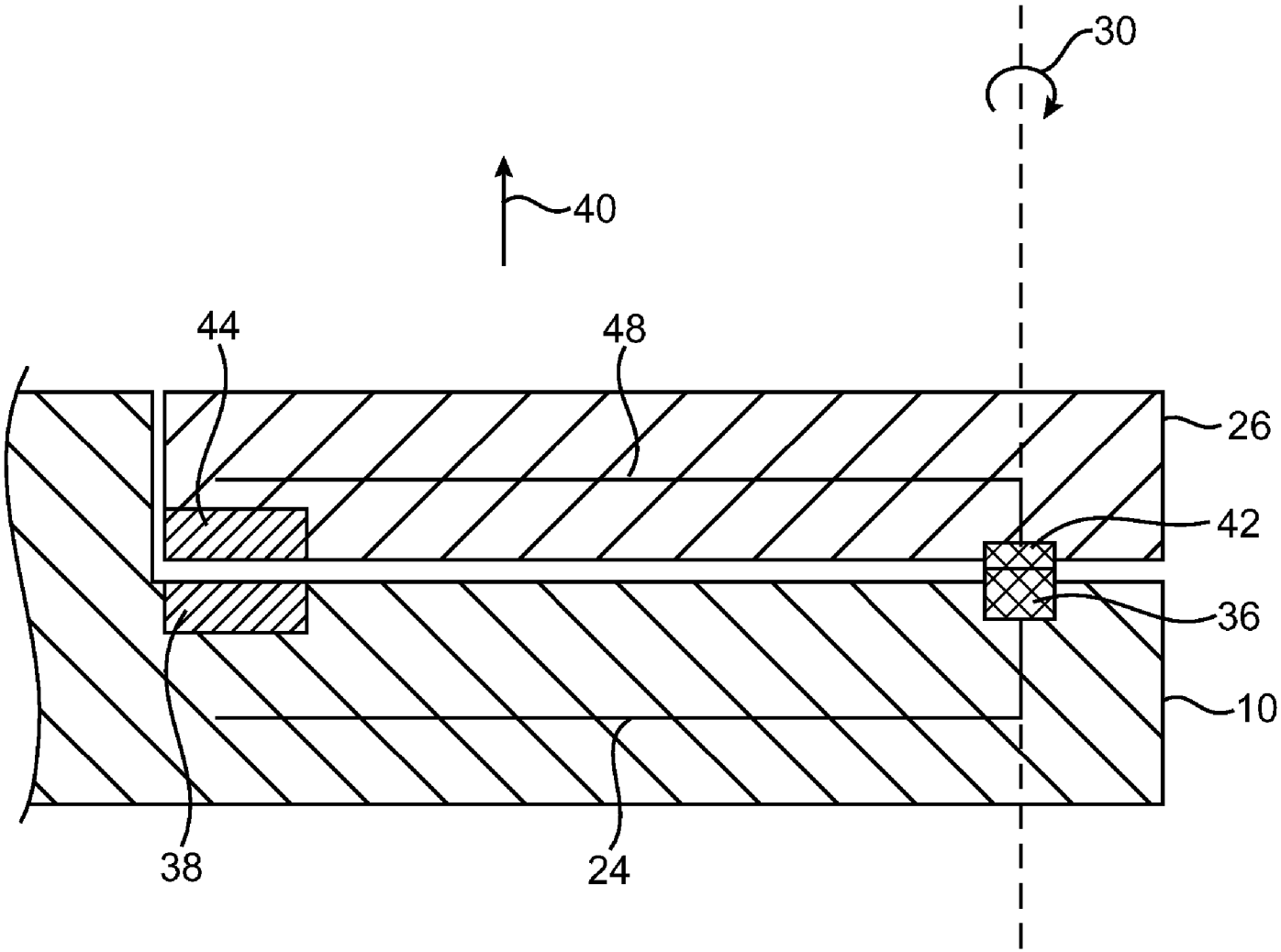
FIG. 8 is a cross-sectional side view of an illustrative extendable, removable antenna in a stowed state and an illustrative antenna receptacle in an electronic device in accordance with an embodiment of the present invention.

FIG. 8 shows a cross sectional view of an illustrative rotating antenna structure 26 and an antenna receptacle of device 10. The antenna structure of FIG. 8 is shown in its stowed state. In the antenna structure's stowed state, the antenna structure and device 10 may be configured to have a uniform and clutter-free visual appearance by aligning outer portions of structure 26 with surrounding portions of device 10. Coupling structures in antenna structure 26 may be configured such that a force acting to move the antenna structure in direction 40 may overcome the magnetic attraction between antenna structure 26 and device 10 before damage occurs to either antenna structure 26 or device 10.

In the FIG. 8 example, antenna structure 26 may be configured to extend by rotating about an axis (e.g., axis 30). Coupling structures 38 and 44 may provide acoustic and/or tactile feedback when the antenna structure moves into or out of its stowed position. For example, when a user rotates the antenna structure towards its stowed position, coupling structures 38 and 44 may magnetically attract each other and pull the antenna structure into its stowed position.

Coupling structures 36 and 42 may be configured to allow antenna structure 26 to rotate about an axis centered on the coupling structures (e.g., coupling structures 36 and 42). The coupling structures may provide acoustic and/or tactile feedback when the antenna structure is positioned in one or more extended positions or in its stowed position. For example, the antenna structures may have steps at certain intervals. The antenna structure may have a preference to move into and stay in the position of the steps.

Coupling structures 36 and 42 may be configured to couple antenna resonating element 48 with communications path 24 and circuitry 18. The coupling between the antenna resonating element and the communications path only occur when the antenna is deployed (or stowed) or alternatively may be independent of the position of the antenna structure. For example, a rotating antenna resonating element may be coupled to the communications path regardless of whether the antenna structure is in its stowed position, a partially extended position, positioned at a certain steps, or a fully extended position, whereas a reciprocating antenna resonating element may only be coupled to communications path 24 when deployed.

Figure 9:
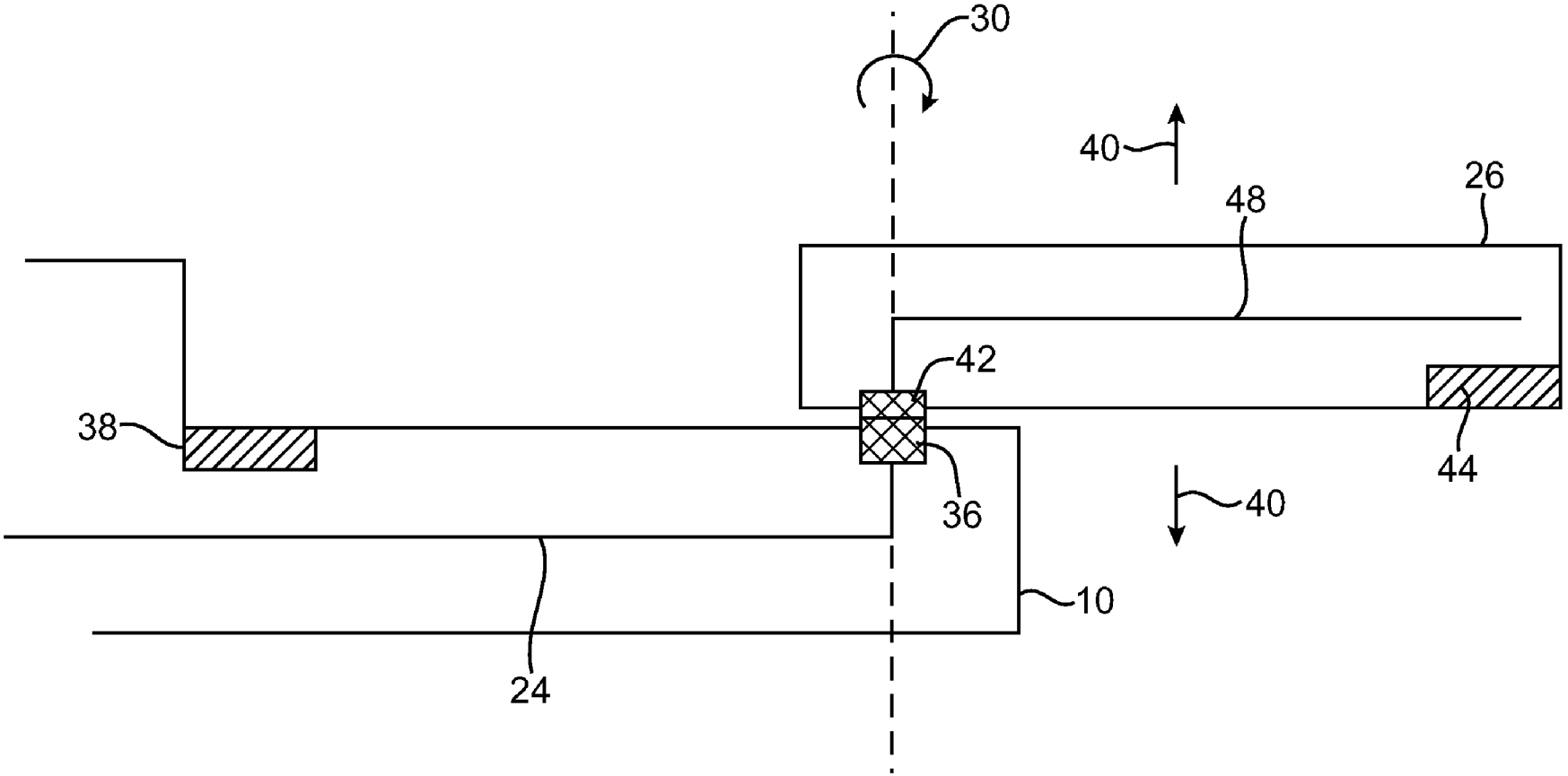
FIG. 9 is a cross-sectional view of an illustrative extendable, removable antenna in an extended state and an illustrative antenna receptacle in an electronic device in accordance with an embodiment of the present invention.

FIG. 9 shows a cross sectional view of antenna structure 26 and an antenna receptacle of device 10. In FIG. 9, the antenna structure of FIG. 8 is shown in a possible extended position. In the antenna structure's extended state, the antenna structure and device 10 may be configured to create a large separation between antenna resonating element 48 and a ground plane of device 10 (e.g., a metal housing of device 10).

As shown in FIG. 9 by lines 40, antenna structure 26 may break away from device 10 without damaging the antenna structure or the device. Antenna structure 26 may be able to break away from device 10 because it is magnetically coupled to device 10 and the magnetic coupling may be configured to be weak enough to release before damage occurs.

In a typical scenario, a user of device 10 may have antenna structure 26 in an extended state while performing wireless communications functions. The antenna structure 26 may have forces acting on it that act to break it away from device 10. For example, a user may inadvertently hit the protruding antenna structure. Because antenna structure 26 is magnetically coupled to device 10, the antenna structure may not be damaged and may simply fall off of device 10. Following the antenna structure's release from device 10, the user may simply reattach the antenna structure by placing it in proximity to the corresponding antenna receptacle (e.g., in proximity to a position such as its stowed position, its extended position, or an intermediate position) and allowing the magnetic coupling to reattach antenna structure 26 to device 10.

Figure 10:
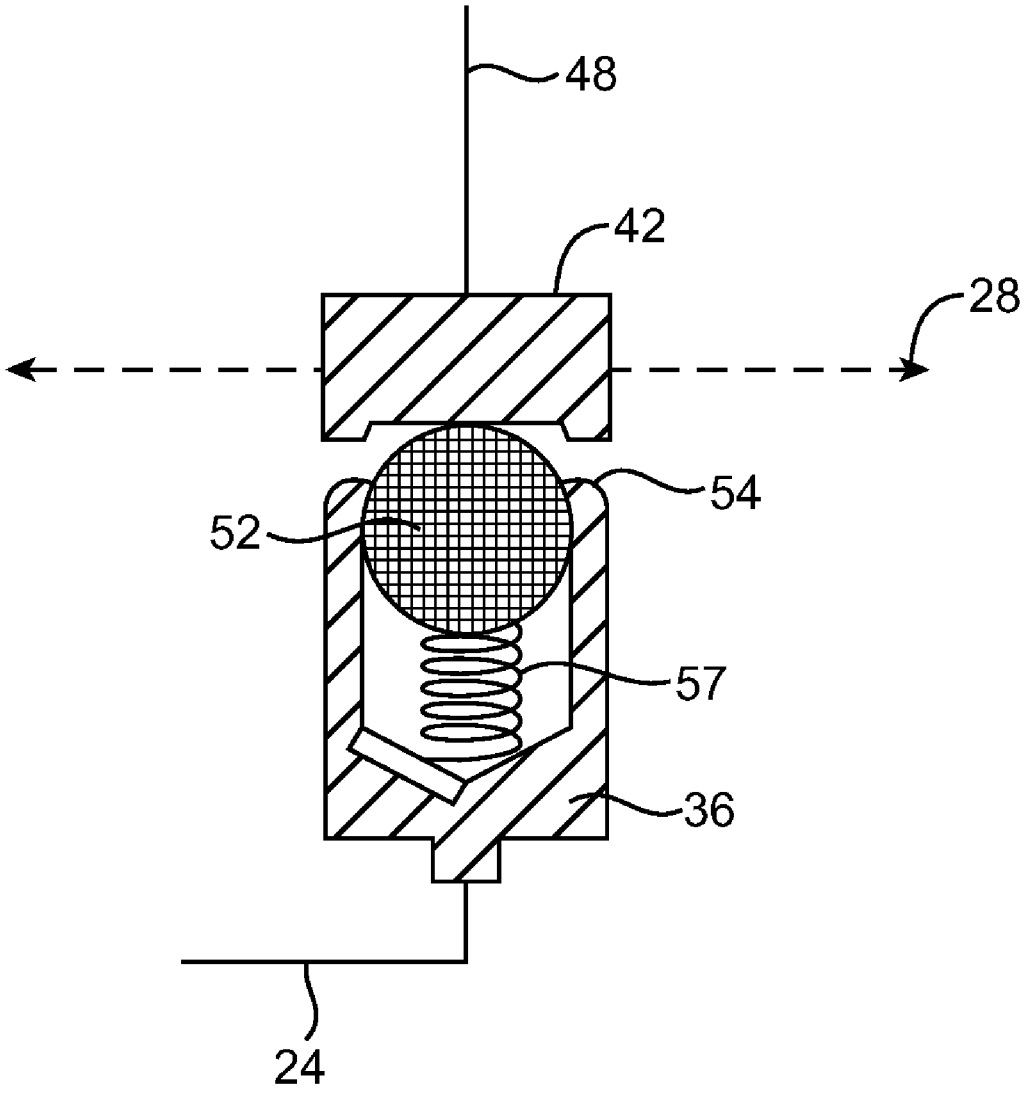
FIG. 10 is a cross-sectional view of an illustrative magnetic coupling structure in an extendable, removable antenna and an illustrative magnetic coupling structure in an antenna receptacle of an electronic device in accordance with an embodiment of the present invention.

A cross-sectional view of illustrative coupling structures 36 and 42 is shown in FIG. 10. Structure 36 (and it associated components such as ball 52) and/or structure 42 may be formed with ferromagnetic or magnetic materials. The structures may be magnetically attracted to each other. Structure 36 may be held fixed in an antenna receptacle of device 10 while structure 42 may be fixed in antenna structure 26 and may generally remain on line 28. Because structures 36 and 42 may be magnetically coupled, structure 42 may break away from structure 36 without causing damage.

In the FIG. 10 example, structures 36 and 42 may form a ball detent. Ball 52 may be contained in the cylindrical walls of structure 36 by a curved upper portion of structure 36 (e.g., retaining structure 54). Ball 52 may be biased against retaining structure 54 by spring 57.

Structure 42 may reciprocate along line 28 as antenna structure 26 transitions between its stowed position and its extended position. As structure 42 becomes aligned with structure 36 (e.g., antenna structure 26 enters its extended position), ball 52 of structure 36 may interact with a recessed portion of structure 42 to provide feedback that structures 36 and 42 have coupled. For example, when structure 42 moves towards a position where it is aligned with structure 36, ball 52 may be biased by spring 57 into a recessed portion of structure 42. As the ball moves into the recessed portion of structure 42 there may be an acoustic and/or tactile feedback alerting the user that structures 36 and 42 have coupled.

The recessed portion of structure 42 may resist forces acting in the directions of line 28 as the edges of the recessed portion impinge ball 52. This resistance may provide feedback as a user moves antenna structure 26 out of its extended position.

Communications path conductor 24 (e.g., a coaxial cable center conductor) may be coupled to antenna resonating element 48 through structures 36 and 42 (including ball 52 of structure 26). Ball 52 may be electrically conductive. For example, ball 52 may be formed entirely from conductive material or may be coated with an electrically conductive coating. Magnetic and ferromagnetic materials may optionally be used in ball 52. Spring 57 and/or structure 36 may be electrically conductive. Structure 42 may be conductive or may have a conductive portion that is electrically coupled to antenna resonating element 48.

Spring 57 may provide a repulsive biasing force against coupling structure 42 (e.g., antenna 26). This repulsive biasing force may be countered by the magnetic attraction of elements 44 and 38. For example, the magnetic attraction of elements 44 and 38 may be strong enough to hold antenna structure 26 to device 10 even when spring 57 (and ball 52) is pushing against structure 42.

Optional magnetic and/or ferromagnetic materials in ball 52 and/or coupling structure 36 and magnetic and/or ferromagnetic materials in coupling structure 42 may provide a magnetic attraction force between coupling structure 36 and/or ball 52 and coupling structure 42. The magnetic attraction force may be stronger than the biasing force provided by spring 57. For example, the magnetic attraction force provided by optional magnetic and ferromagnetic materials in ball 52 and/or coupling structures 36 and 42 and the repulsive force spring 57 provides may be configured such that there is a net attractive force between coupling structure 36 and/or ball 52 and coupling structure 42.

Figure 11:
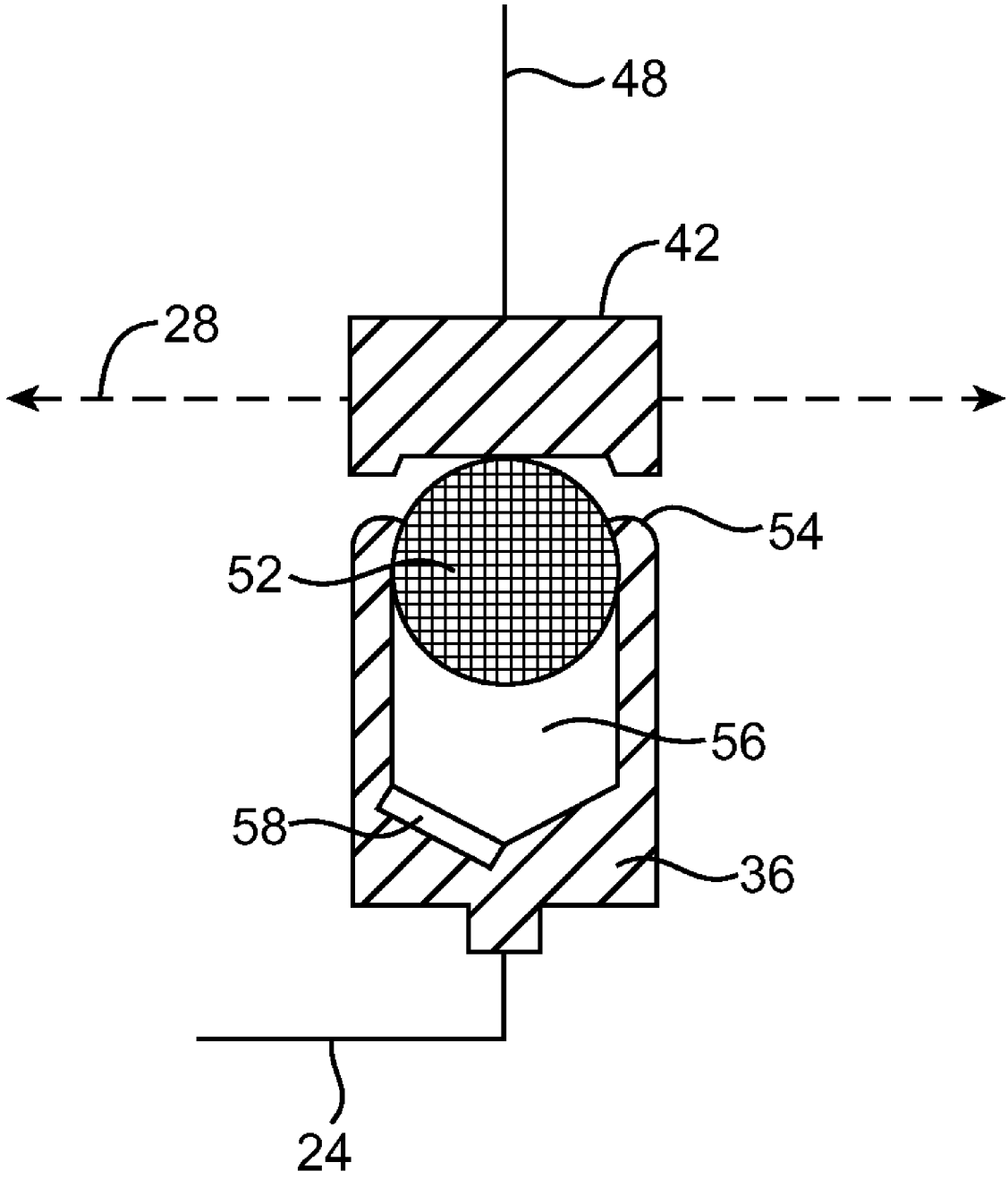
FIG. 11 is a cross-sectional view of an illustrative magnetic coupling structure in an extendable, removable antenna and an illustrative magnetic coupling structure in an antenna receptacle of an electronic device in accordance with an embodiment of the present invention.

A cross-sectional view of another set of illustrative coupling structures 36 and 42 is shown in FIG. 11. Structure 36 and/or structure 42 of FIG. 11 may be formed from ferromagnetic or magnetic materials. The structures may be magnetically attracted to each other. Structure 36 may be held fixed in an antenna receptacle of device 10 while structure 42 may be fixed in antenna structure 26 and may generally remain on line 28. Because structures 36 and 42 may be magnetically coupled, structure 42 may break away from structure 36 without causing damage.

In the FIG. 11 example, structures 36 and 42 may form a ball detent with no spring. Ball 52 may be formed from ferromagnetic or magnetic materials. In a ball detent with no spring, ball 52 may be biased against retaining structure 54 by a magnetic attraction with structure 42. In another embodiment, a movable structure within structure 36 such as ball 52 may be biased against retaining structure 54 by a magnetic repulsion with a magnetic portion of structure 36. The ball detent arrangement of FIG. 11 may retain all the features of the ball detent of FIG. 10 with the biasing force of spring 57 replaced by a magnetic attraction or repulsion between ball 52 and structure 42 or structure 36, respectively.

The ball detent arrangements of FIGS. 10 and 11 may be self-cleaning. For example, as coupling structure 42 moves relative to coupling structure 36, ball 52 may rotate or otherwise move around inside of coupling structure 36. The motion of ball 52 may cause the surface of ball 52 to wipe against structure 42, retaining structure 54, or a portion of structure 36. As the surface of ball 52 wipes against another surface, the surface of ball 52 may be cleared of dirt or other debris, thereby helping ball 52 to make good electrical contact with other coupling structures.

The ball detent arrangements of FIGS. 10 and 11 may also distribute wear evenly on ball 52 and allow for better optimization of the ball detent coupling. For example, because ball 52 is relatively free to move around in coupling structure 36, the wear that occurs during normal operation may be evenly distributed on the surface of ball 52 thereby extending its serviceable lifetime. The distribution of wear evenly on ball 52 may also allow for coatings on ball 52 that are optimized for electrical properties (e.g., resistance) rather than coatings that are optimized for durability. The even distribution of wear on ball 52 may also increase the magnitude of tolerable forces on the ball detent arrangement.

Optional sensor 58 may be used to determine the position of ball 52. The position of ball 52 may be a means of determining the position of structure 26 (i.e., whether structure 42 and structure 36 are coupled and therefore whether antenna structure 26 is in its extended position). Sensor 58 may be coupled to circuitry 18 to control the operation of wireless communications devices 82 or other components in device 10.

Communications path 24 may be coupled to antenna resonating element 48 through structures 36 and 42 (including ball 52). Ball 52 may be formed from an electrically conductive material or may be coated with an electrically conductive coating. The walls of structure 36 may also be electrically conductive. Structure 42 may be conductive or may have a conductive portion that is electrically coupled to antenna resonating element 48.

Figure 12:
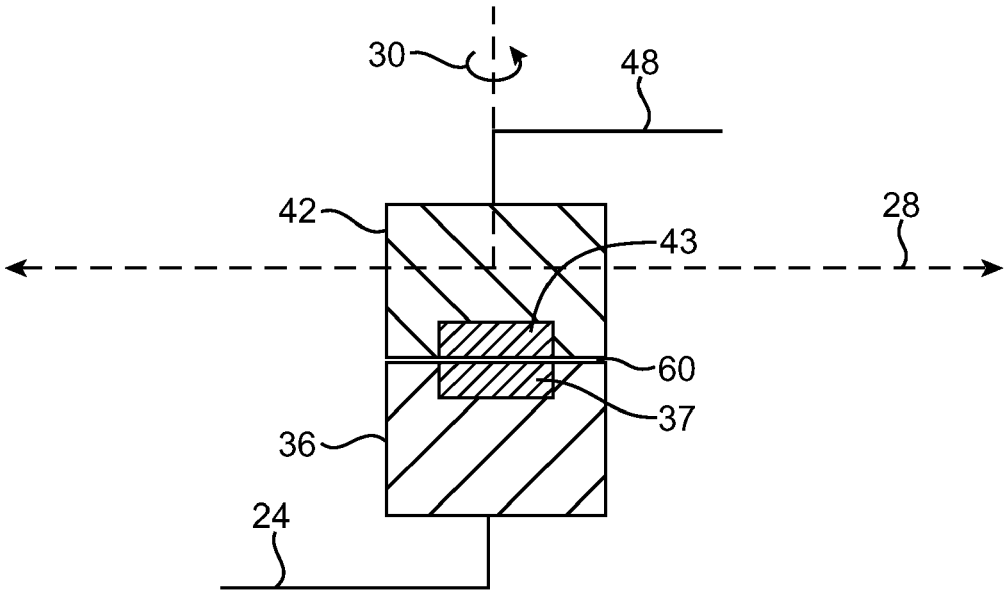
FIG. 12 is a cross-sectional view of an illustrative magnetic coupling structure in an extendable, removable antenna and an illustrative magnetic coupling structure in an antenna receptacle of an electronic device in accordance with an embodiment of the present invention.

A cross-sectional view of another suitable arrangement for coupling structures 36 and 42 is shown in FIG. 12. In the FIG. 12 embodiment, attraction elements 37 and 43 may provide a magnetic attraction force that couples structures 36 and 42 together. Attraction elements 37 and 43 may made from magnetic or ferromagnetic materials as needed to provide the magnetic attraction force between coupling structures 36 and 42. For example, element 37 may be made from magnetic materials while element 43 may be made from ferromagnetic materials. Alternatively, both attraction elements may be made from magnetic materials.

In the FIG. 12 example, coupling structure 42 may reciprocate along axis 28 when antenna structure 26 transitions between its extended and stowed positions (i.e., similar to FIGS. 10 and 11). Coupling structures 36 and 42 may provide feedback such as tactical and/or acoustic feedback when antenna structure 26 transitions into or out of its extended position. For example, the user may be able to feel the magnetic attraction and then allow the coupling structures to bring themselves into the correct position via their magnetic attraction.

In one embodiment, coupling structure 42 may rotate about axis 30 when antenna structure 26 transitions between its stowed position and its extended positions (i.e., when structure 26 moves in a direction such as direction 370 as shown in FIG. 5).

Communications path 24 may be coupled to antenna resonating element 48 through structures 36 and 42. Structures 36 and 42 or portions of structures 36 and 42 may be electrically conductive. Attraction elements 37 and 43 or portions of attraction elements 37 and 43 may also be electrically conductive.

Figure 13:
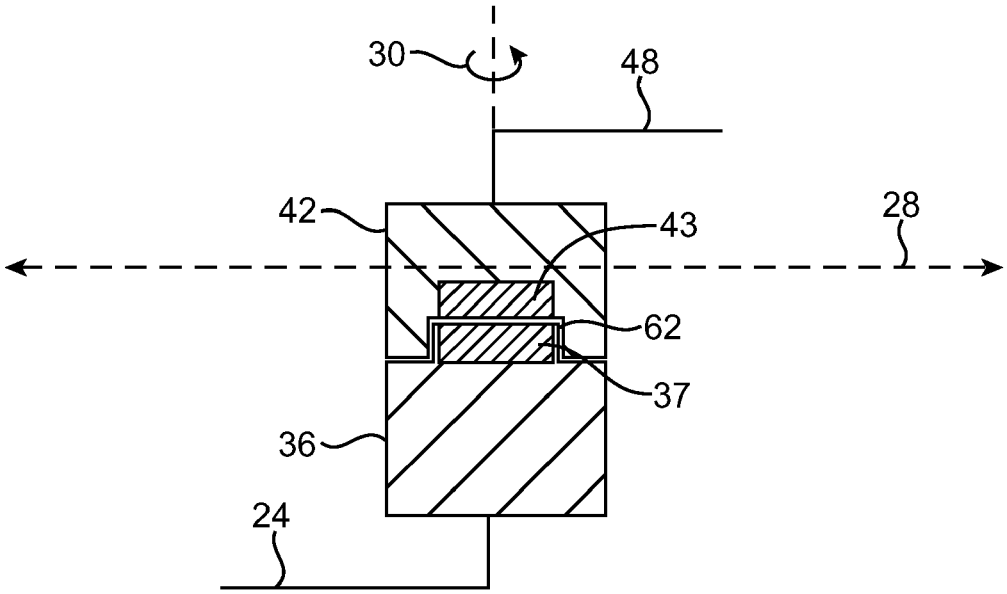
FIG. 13 is a cross-sectional view of another illustrative magnetic coupling structure in an extendable, removable antenna and an illustrative magnetic coupling structure in an antenna receptacle of an electronic device in accordance with an embodiment of the present invention.

In FIG. 13, the illustrative coupling structures of FIG. 12 have been provided with a protrusion to coupling structure 36 and a corresponding section of structure 42 has been shaped to accommodate the protrusion. Edge 62 outlines the shape of the interface between coupling structures 36 and 42.

When antenna structure 26 is configured to reciprocate along axis 28, the interface shown in FIG. 13 may increase the feedback that occurs when antenna structure 26 enters or leaves its extended position. For example, the protrusion of structure 37 may suddenly drop into the recessed portion of structure 42 and create feedback that is more apparent to a user than the FIG. 12 embodiment.

When antenna structure 26 is configured to rotate about axis 30 (i.e., when structure 26 moves in a direction such as direction 370 as shown in FIG. 5), the interface shown in FIG. 13 may help coupling structure 42 maintain its coupling with structure 36 as the antenna structure is rotated about axis 30. The interface of FIG. 13 may limit non-rotational movement between structures 36 and 42. For example, edge 62 may cause structures 36 and 42 to stay aligned even as non-rotational forces acting to move antenna structure 26 away from axis 30 act upon the coupling structures (e.g., structures 36 and 42).

Figure 14:
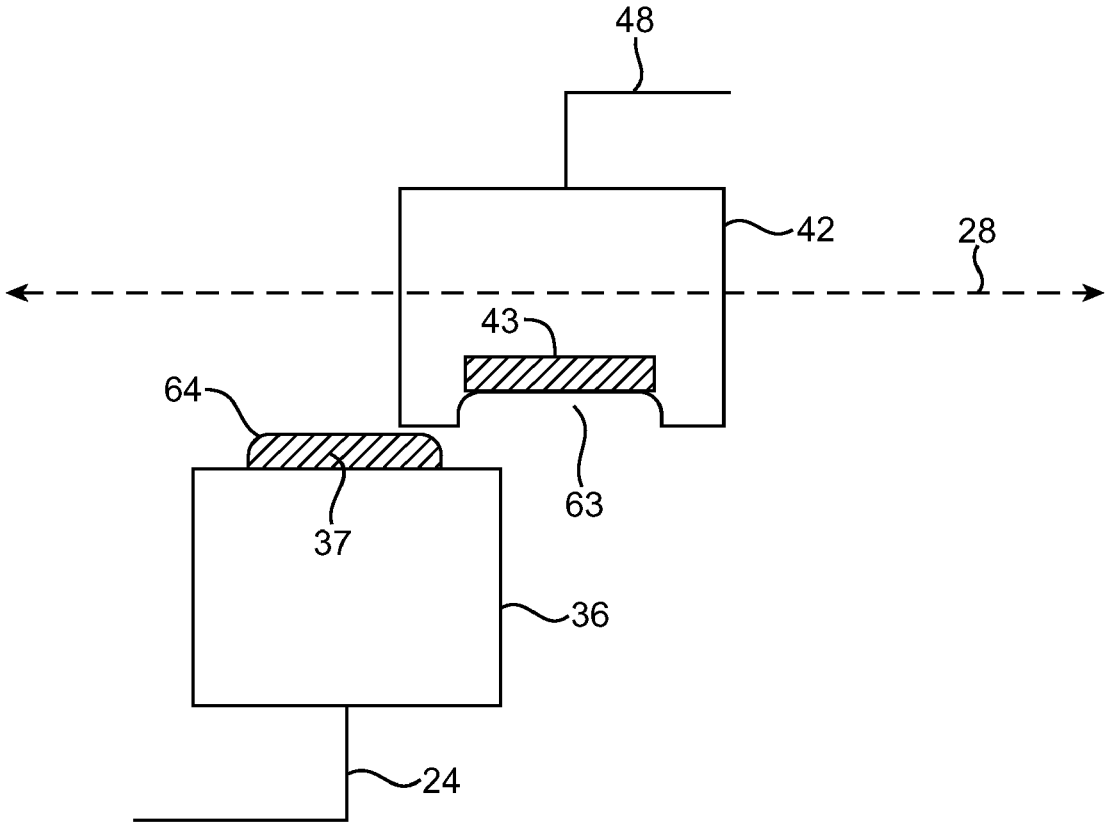
FIG. 14 is a cross-sectional view of an illustrative partly decoupled magnetic coupling structure in an extendable, removable antenna and an illustrative magnetic coupling structure in an antenna receptacle of an electronic device in accordance with an embodiment of the present invention.

In FIG. 14, the coupling structures of FIG. 13 are illustrated in a nearly coupled state that may occur just before or just after antenna structure 26 is in its extended position. There may be a void (e.g., void 63) in coupling structure 42 and there may be a corresponding protrusion 64 in coupling structure 36 that align when the antenna structure is in its extended position.

Void 63 and protrusion 64 may provide feedback to a user of device 10 when extending antenna structure 26 along line 28 into its extended position. As antenna structure 26 enters its extended position, protrusion 64 may suddenly drop into void 63 and in doing so may create feedback informing the user that the antenna structure is correctly in its extended position. The feedback may be, for example, an audible sound or may be tactile feedback such as antenna structure 26 suddenly shifting into its extended position.

Figure 15:
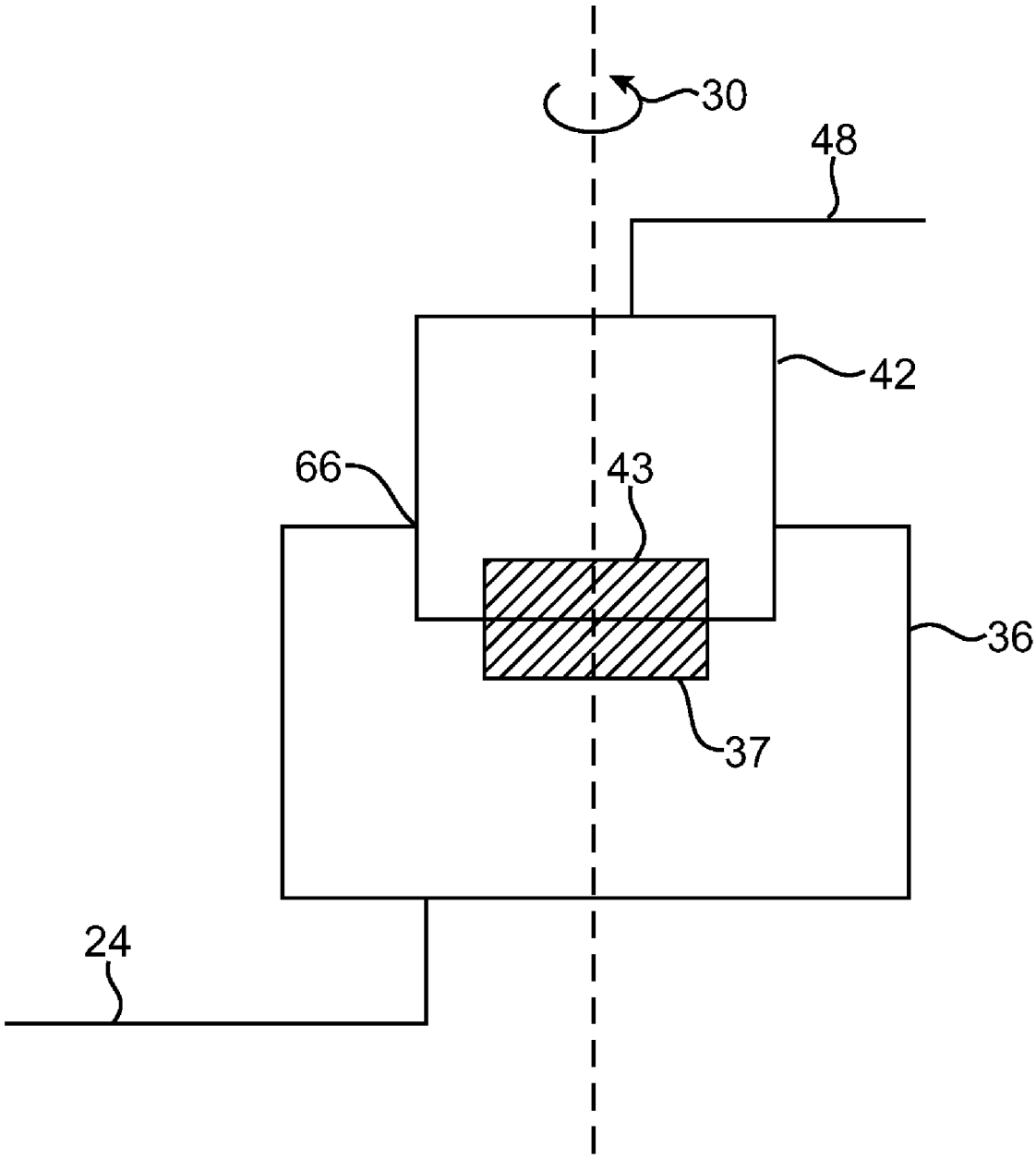
FIG. 15 is a cross-sectional view of illustrative magnetic coupling structures in a rotatable antenna coupling arrangement in accordance with an embodiment of the present invention.

In the FIG. 15 example, an illustrative embodiment of coupling structures 36 and 42 is shown. The coupling structures illustrated by FIG. 15 may be suitable in antenna structures such as antenna structure 26 that are configured to extend and stow by rotating about an axis such as axis 30 (FIG. 4).

Coupling structures 36 and 42 may be configured to have an interface such as interface 66 that is symmetric about the axis of rotation (e.g., axis 30). For example, coupling structure 36 may have a cylindrical depression and coupling structure 42 may have a corresponding cylindrical protrusion. The interface may allow structure 42 to freely rotate about axis 30 while limiting the movement of structure 42 in directions perpendicular to axis 30.

Coupling structures 36 and 42 may be configured to provide feedback such as acoustic and/or tactile feedback when antenna structure 26 is in certain positions. For example, as antenna structure 26 and hence coupling structure 42 rotate about axis 30, structures 36 and 42 may be configured to provide resistance at certain intervals in the rotation of structure 26 around axis 30. As one possible example of how structures 36 and 42 may provide feedback, coupling structures 36 and 42 may implement a ball detent arrangement using evenly spaced ball receptacles arranged circularly around the protrusion of structure 42 and one or more balls in structure 36 biased to mate with receptacles of structure 42.

With another suitable arrangement, coupling structures 36 and 42 may be non-cylindrical structures that provide positional feedback as antenna 26 is rotated between its retracted position and one or more extended positions. For example, coupling structures 36 and 42 may configured as corresponding coupling structures that have a predominantly square shape that provides detents (e.g., click-stops) every ninety degrees. In general, coupling structures 36 and 42 may be configured with any suitable shape to provide click-stops at any desired interval or position. For example, structures 36 and 42 may be formed in a rectangular shape to provide detents every 180 degrees, a triangular shape to provide detents every 120 degrees, a hexagonal shape to provide detents every 60 degrees, etc. Structures 36 and 42 may also be configured in a non-symmetrical shape that provides click-stops at irregular intervals (such as 0 degrees of extension as well as 90 and 120 degrees of rotational extension).

Attraction elements 37 and 43 may be cylindrical disks that may be centered on or near axis 30. Attraction elements 37 and 43 may be made from ferromagnetic or magnetic materials and may provide a magnetic force that provides a physical coupling force to hold together structures 36 and 42. Attraction elements 37 and 43 may be configured to provide enough magnetic force to retain antenna structure 26 on device 10 during normal operations while providing a sufficiently weak magnetic force to avoid damage to antenna structure 26 on device 10 under larger than normal stresses or forces (e.g., when a user accidently pushes or pulls antenna structure 26).

Figure 16:
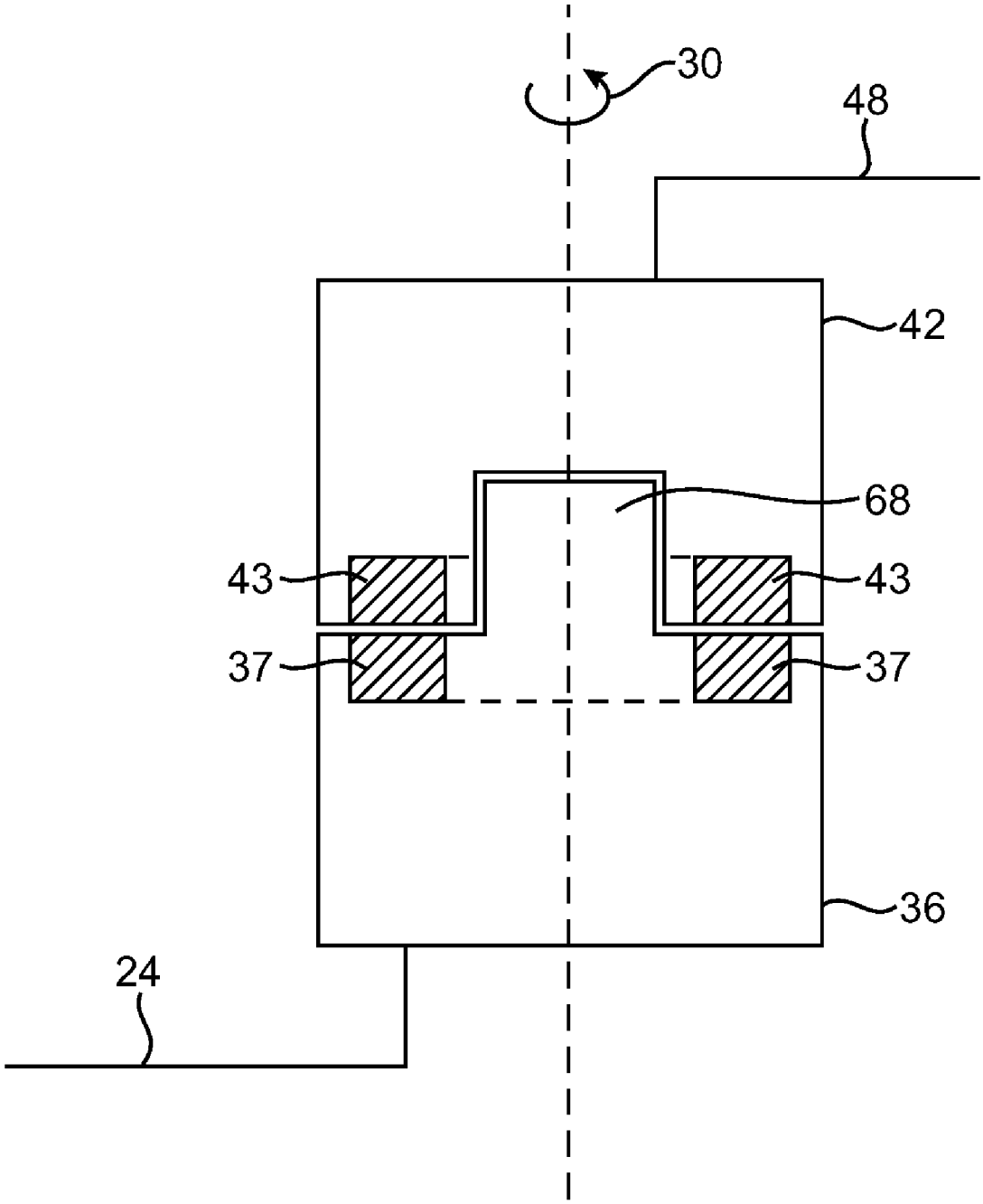
FIG. 16 is a cross-sectional view of illustrative magnetic coupling structures in a rotatable antenna coupling arrangement in accordance with an embodiment of the present invention.

FIG. 16 shows an illustrative embodiment of coupling structures 36 and 42 that may be suitable for antenna structures such as antenna structure 26 that are configured to extend and stow by rotation about an axis such as axis 30.

Coupling structure 36 of FIG. 16 may have a cylindrical protrusion such as protrusion 68 that may fit into a corresponding cylindrical depression in coupling structure 42. The mating of the two cylindrical features of the coupling structures may limit the relative movement between the two coupling structures (e.g., structures 36 and 42) in directions perpendicular to axis 30 while freely allowing structure 42 to rotate about structure 36 and around an axis of rotation (e.g., axis 30).

Magnetic attraction elements 37 and 43 may be arranged in circular rings that may be centered on or near axis 30. Magnetic attraction elements 37 and 43 may be made from ferromagnetic or magnetic materials and may provide a magnetic force that provides a physical coupling force to hold together structures 36 and 42. Magnetic attraction elements 37 and 43 may be configured to provide enough magnetic force to retain antenna structure 26 on device 10 during normal operations but insufficient magnetic force to create damage to antenna structure 26 on device 10 when a user accidently pushes or pulls antenna structure 26.

The coupling structures of FIGS. 12, 13, 14, 15, and 16 (e.g., coupling structures 36 and 42) may capacitively couple communications path 24 to antenna resonating element 48. For example, coupling structures 36 and 42 may not physically connect communications path 24 to antenna resonating element 48. Structures 36 and 42 may bring portions of path 24 and element 48 into a close physical proximity so that path 24 and element 48 are capacitively coupled together and signals pass between path 24 and element 48 without a direct physical connection.

The spring-loaded coupling structures (e.g., from FIGS. 10 and 11) and the attractive coupling structures (e.g., from FIGS. 12, 13, 14, 15, 16, and 17) may help to ensure electrical contact even with manufacturing tolerances. For example, coupling structures such as structures 36 and 42 may allow for manufacturing tolerances that are less restrictive while still ensuring good electrical contact between antennas such as antenna 26 and antenna 27 and electronic devices such as device 10.

Figure 17:
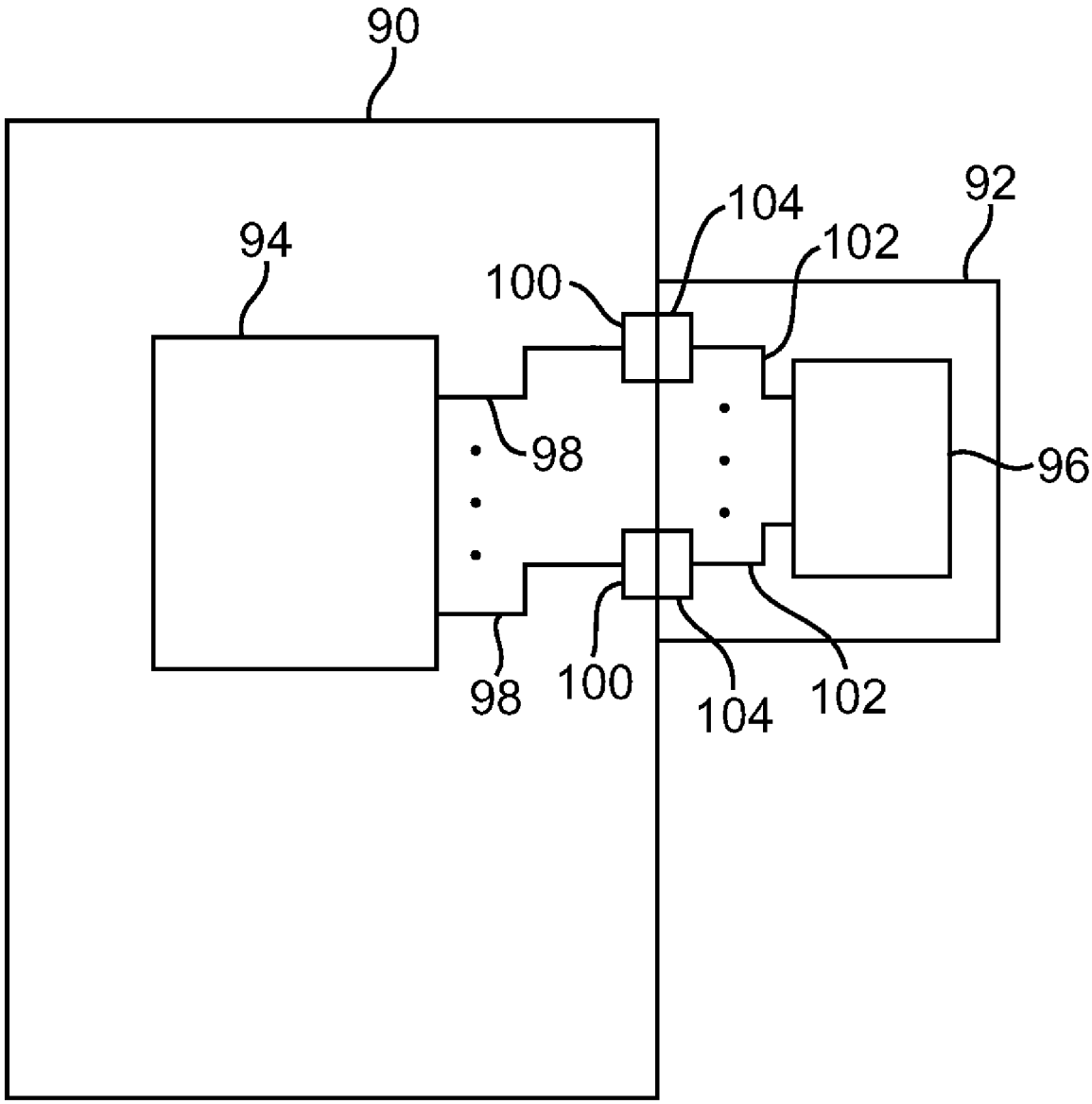
FIG. 17 is a schematic circuit diagram of illustrative equipment with circuitry that may be electrically coupled with magnetic coupling structures in accordance with an embodiment of the present invention.

A schematic diagram of devices that have circuitry that may be electrically coupled with magnetic coupling structures is shown in FIG. 17. A first device such as device 90 may have circuitry 94 and a second device such as device 92 may have may have circuitry 96. Circuitry 94 and circuitry 96 may be any suitable circuitry. For example, the circuitry may be processing circuitry, sensor circuitry, communications circuitry, storage circuitry, antenna structure circuitry (e.g., an antenna resonating element), input-output circuitry, etc. Device 90 and device 92 may be any suitable devices such as electronic devices, handheld electronic devices, portable electronic devices such as laptop computers, antenna structures such as structure 26, electronic components, or other suitable devices.

Circuitry 94 and circuitry 96 may be electrically coupled through one or more coupling structures 100 in device 90 and one or more corresponding coupling structures 104 in device 92. Coupling structures 100 and 104 may be formed from magnetic and/or ferromagnetic material so that they are magnetically attracted to each other. Communications paths 98 may carry signals from circuitry 94 to coupling structures 100. Communications paths 102 may carry signals from circuitry 96 to coupling structures 104. There may be any suitable number of communications paths and corresponding coupling structures. Communications paths 98 and 102 may carry any suitable signal such as power supply signals, ground signals, analog signals, digital signals, radio-frequency signals, DC signals associated with sensors such as position sensors, etc. If desired, a detection signal may be carried by communications paths 98 and 102 and coupling structures 100 and 104. The detection signal may indicate when the first device and the second device have magnetically coupled (e.g., physically and electrically).

Coupling structures 100 and 104 may be made from ferromagnetic and/or magnetic materials. With one suitable arrangement, coupling structures 100 and 104 are made from magnetic materials. With another suitable arrangement, coupling structures 100 are made from magnetic materials while coupling structures 104 are made from ferromagnetic materials or vice versa.

Coupling structures 104 may physically couple device 92 to device 90 by magnetically attracting coupling structures 100. Coupling structures 104 may also electrically couple communications paths 102 to communications paths 98 (e.g., circuitry 96 to circuitry 94) by electrically coupling with coupling structures 100. Electric coupling between coupling structures 100 and 104 may occur when the coupling structures are physically coupled. For example, the coupling structures may themselves be electrically conductive and may provide an electrical coupling whenever coupling structures 100 are brought into physical contact with coupling structures 104. The coupling structures may also contain or be associated with suitable electrical coupling structures such as a pin and socket arrangements. As an example, the coupling structures may have a pin and socket arrangement in which structures 100 have electrically conductive pins that spring out and structure 104 have electrically conductive sockets designed to receive the pins.

With another suitable arrangement, communications paths 102 and 104 may be capacitively coupled together when coupling structures 100 and 104 are physically coupled. When communications paths 102 and 104 are capacitively coupled together, signals can be conveyed between circuitry 94 and circuitry 96 without a direct physical path between circuitry 94 and circuitry 96.

Figure 18:
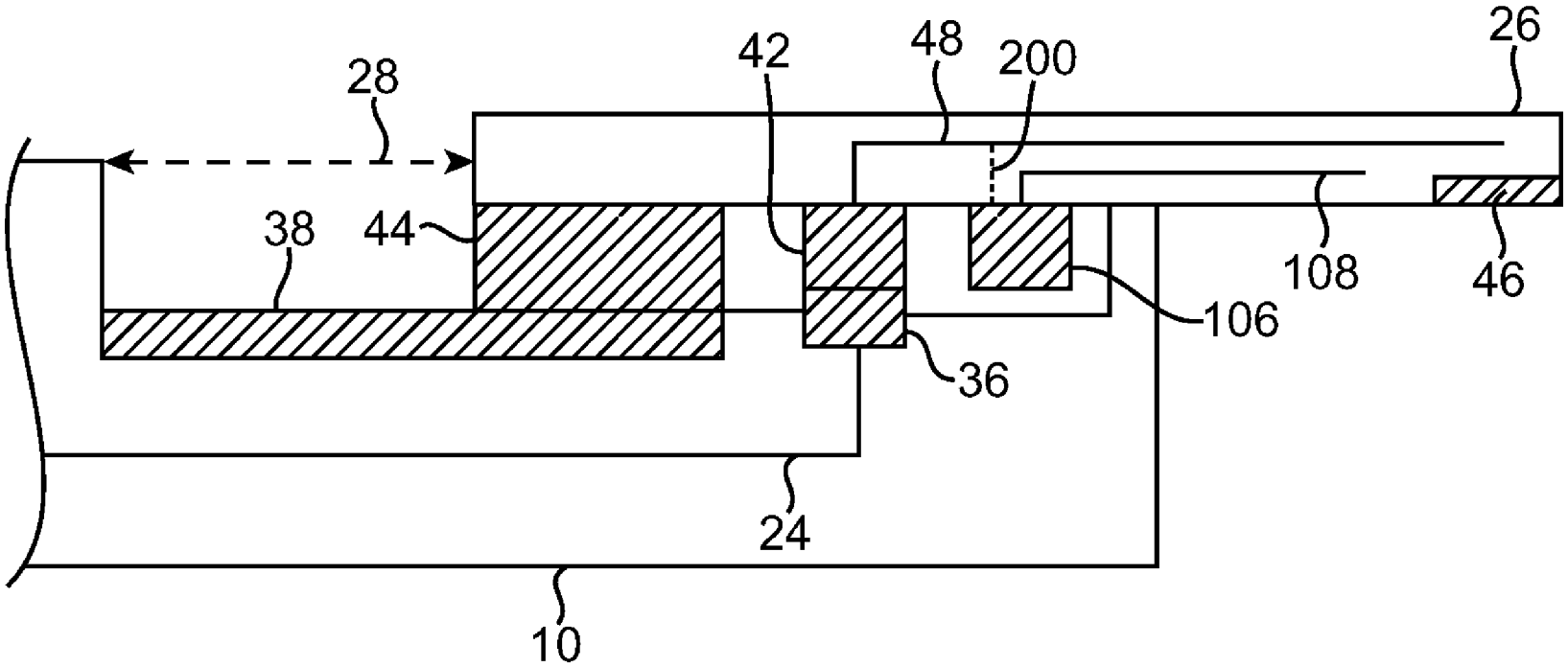
FIG. 18 is a cross-sectional view of illustrative magnetic coupling structures in an extendable, removable antenna and an illustrative magnetic coupling structure in an antenna receptacle of an electronic device in accordance with an embodiment of the present invention.

As shown in FIG. 18, antenna structure 26 may have more than one coupling structures with corresponding antenna resonating elements. For example, antenna structure 26 may have a first coupling structure such as coupling structure 42 and a corresponding antenna resonating element such as resonating element 48 and may also have a second coupling structure such as coupling structure 106 and a corresponding antenna resonating element such as resonating element 108.

The antenna structure of FIG. 18 may have multiple extended positions each of which corresponds to a particular coupling structure of antenna structure 26 (e.g., structure 42 or 106) aligning with and coupling to coupling structure 36 of device 10. For example, as antenna structure 26 is translated towards the stowed position from the position shown in FIG. 18 along line 28, coupling structure 106 may align with and couple to coupling structure 36.

The multiple antenna resonating elements of FIG. 18 may be individually optimized for performance in a particular radio-frequency band. For example, antenna resonating element 48 may be optimized for performance in the 2.4 GHz band that is sometimes used for Wi-Fi® (IEEE 802.11) and Bluetooth® communications while antenna resonating element 108 may be optimized for performance in a 3G data band (e.g., the UMTS band at 1920-2170 MHz).

With another suitable arrangement, multiple coupling structures on antenna 26 may be used to couple communications path 24 to antenna resonating element 48 at multiple feed points (e.g., as illustrated by dotted line 200). When antenna 26 is in its fully deployed state, communications path 24 may be coupled to the end of element 48 through structures 36 and 42. When antenna 26 is in its partially deployed stated, communications paths 24 may be coupled to element 48 somewhere along its length (e.g., not at to the end of element 48) through structures 36 and 106 (and through path 200). Antenna 26 and resonating element 26 may have different resonances based on where path 24 is coupled to element 26. For example, by moving antenna 26 between one or more partially extended states and the fully extended state and thereby coupling path 24 to different sections of antenna resonating element 26, a user may configure antenna 26 to operate in one of multiple frequencies.

Figure 19:
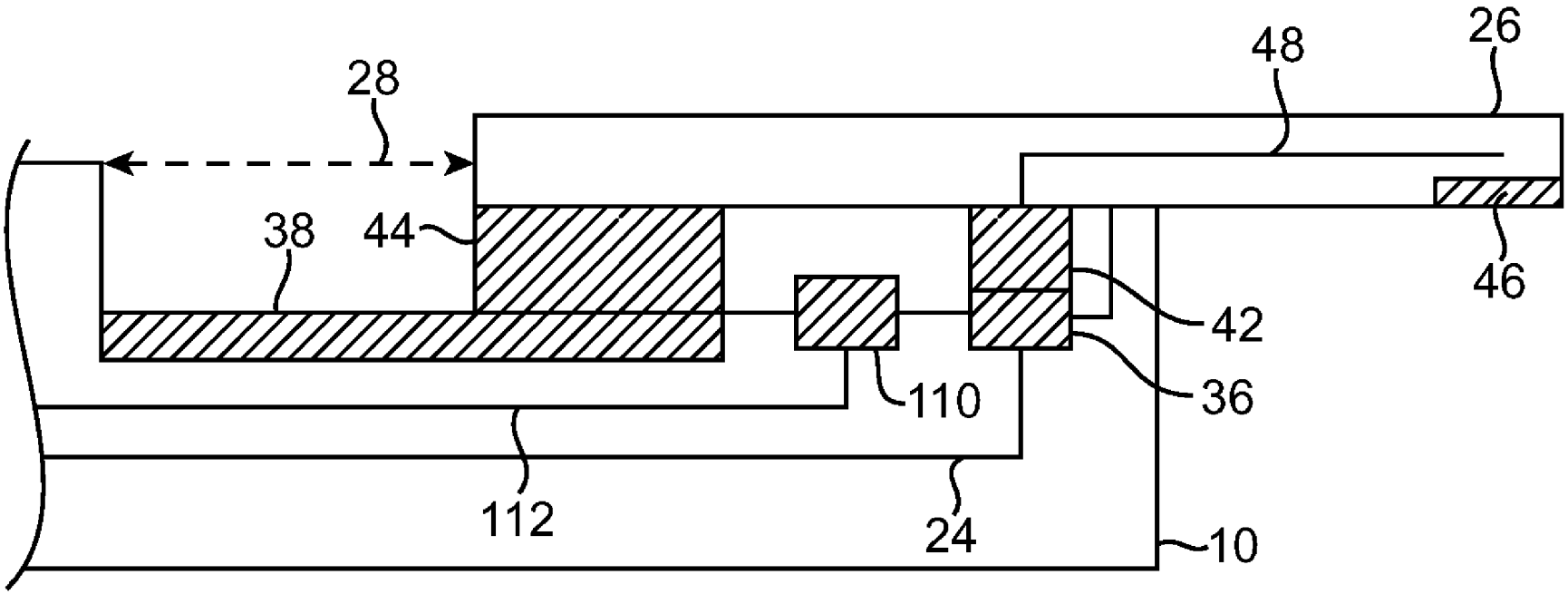
FIG. 19 is a cross-sectional view of an illustrative magnetic coupling structure in an extendable, removable antenna and illustrative magnetic coupling structures in an antenna receptacle of an electronic device in accordance with an embodiment of the present invention.

FIG. 19 illustrates that device 10 may have more than one coupling structures that couple to a common resonating element depending the extended position of antenna structure 26. For example, in a fully-extended position, coupling structure 36 and antenna resonating element 48 may be coupled to coupling structure 36 and a first communications path 24. In a partially-extended position, coupling structure 110 and antenna resonating element 48 may be coupled to coupling structure 110 and a second communications path 112.

The multiple coupling structures and communications paths of device 10 may provide a user with an opportunity to configure antenna structure 26 or device 10 through a physical interaction with the antenna structure. For example, coupling structure 110 may be configured to convey half the transmission power to antenna resonating element 48 that coupling structure 42 is configured to convey so that a user may choose whether to conserve power or have maximum performance. In another example, coupling structure 110 may coupled to a Wi-Fi radio-frequency transceiver (e.g., 2.4 GHz transceiver) through communications path 112 and coupling structure 36 may be coupled to a 3G data radio-frequency transceiver (e.g., 1920-2170 MHz transceiver) through communications path 24.

Figure 20:
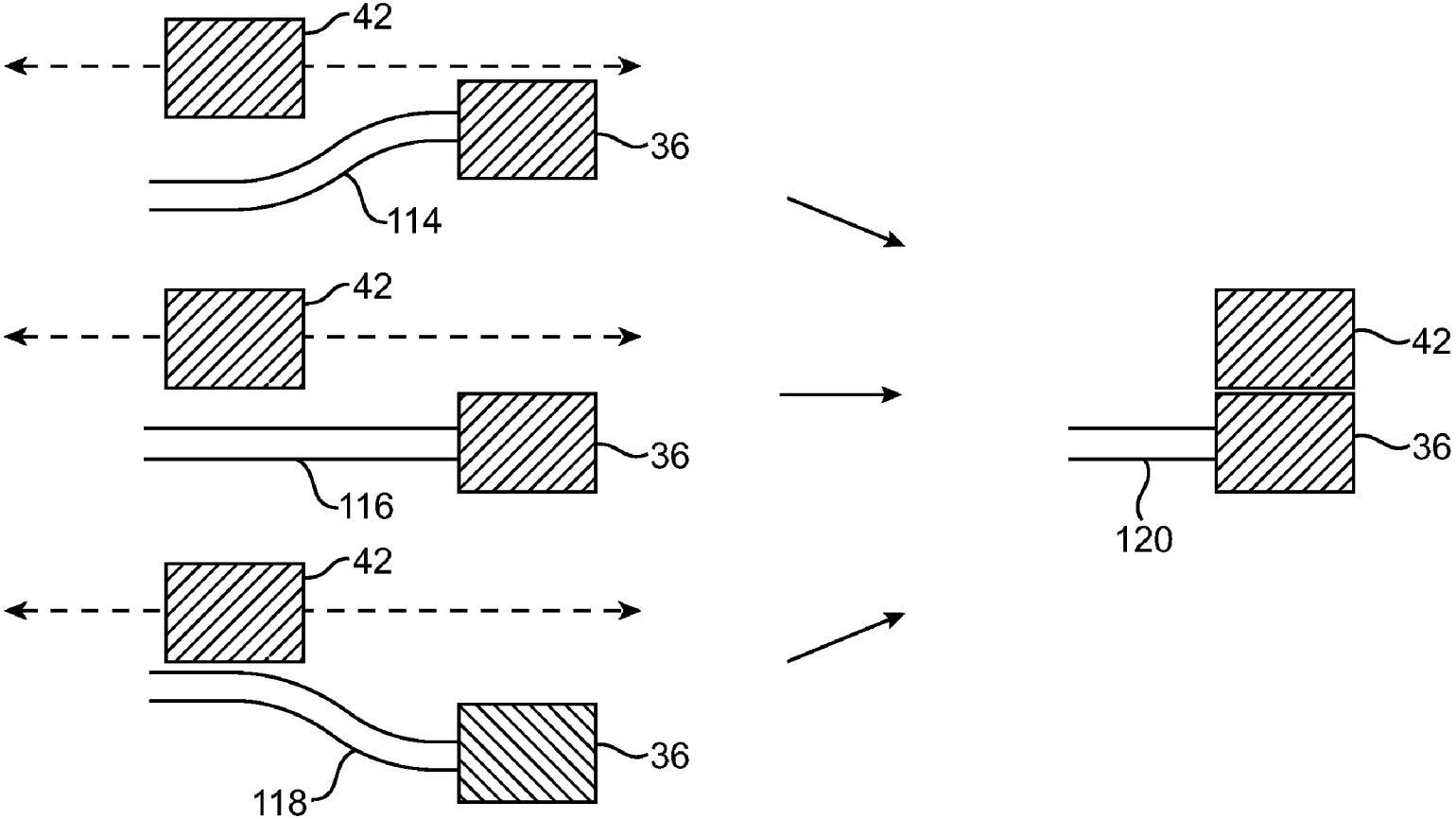
FIG. 20 is cross-sectional view of illustrative flexible mounting structures that may support an illustrative magnetic coupling structure in an antenna receptacle of an electronic device in accordance with an embodiment of the present invention.

As shown in FIG. 20, coupling structure 36 may be mounted on a flexible mounting structure such as mounting structure 114, 116, or 118. Each flexible mounting structure may bias structure 36 in a different direction (or not at all) relative to coupling structure 42. Each flexible mounting structure may deform to the shape of mounting structure 120 when structures 36 and 42 are coupled. The use of flexible mounting structures such as structure 114, 116, or 118 may help to ensure electrical contact between circuitry 94 and circuitry 96 even if manufacturing tolerances are not strict.

Flexible mounting structure 114 may bias structure 36 towards structure 42 when the coupling structures are coupled. The biasing of structure 36 against structure 42 may result from the flexing of mounting structure 114 into the shape of mounting structure 120 and may result in increased electrical conductivity between the coupling structures.

Flexible mounting structure 116 may have an approximately neutral biasing force when structures 36 and 42 are coupled. Because the shape of mounting structure 116 is approximately the same as the shape of mounting structure 120, flexible mounting structure 116 may have a negligible biasing force.

Flexible mounting structure 118 may bias structure 36 away from structure 42 when structures 36 and 42 are coupled. The biasing of structure 36 away from structure 42 may result as the flex of mounting structure 118 is straightened into the shape of mounting structure 120.

Flexible mounting structures 114, 116, and 118 may configured to optimize antenna structure 26 and its interaction with device 10. For example, mounting structure 114 may result in increased electrically conductivity in the electrical path through structures 36 and 42 as the contact force between the two structures is increased. Mounting structure 118 may result in increased tactile feedback when structures 36 and 42 are coupled. Configurations with a mounting structure such as mounting structure 118 may also result in an improved visual appearance of antenna structure 26 as the antenna structure is pulled closer to device 10 by the biasing force of the coupling structures (e.g., by the force of mounting structure 118 attempting to maintain its original shape).

Figure 21:
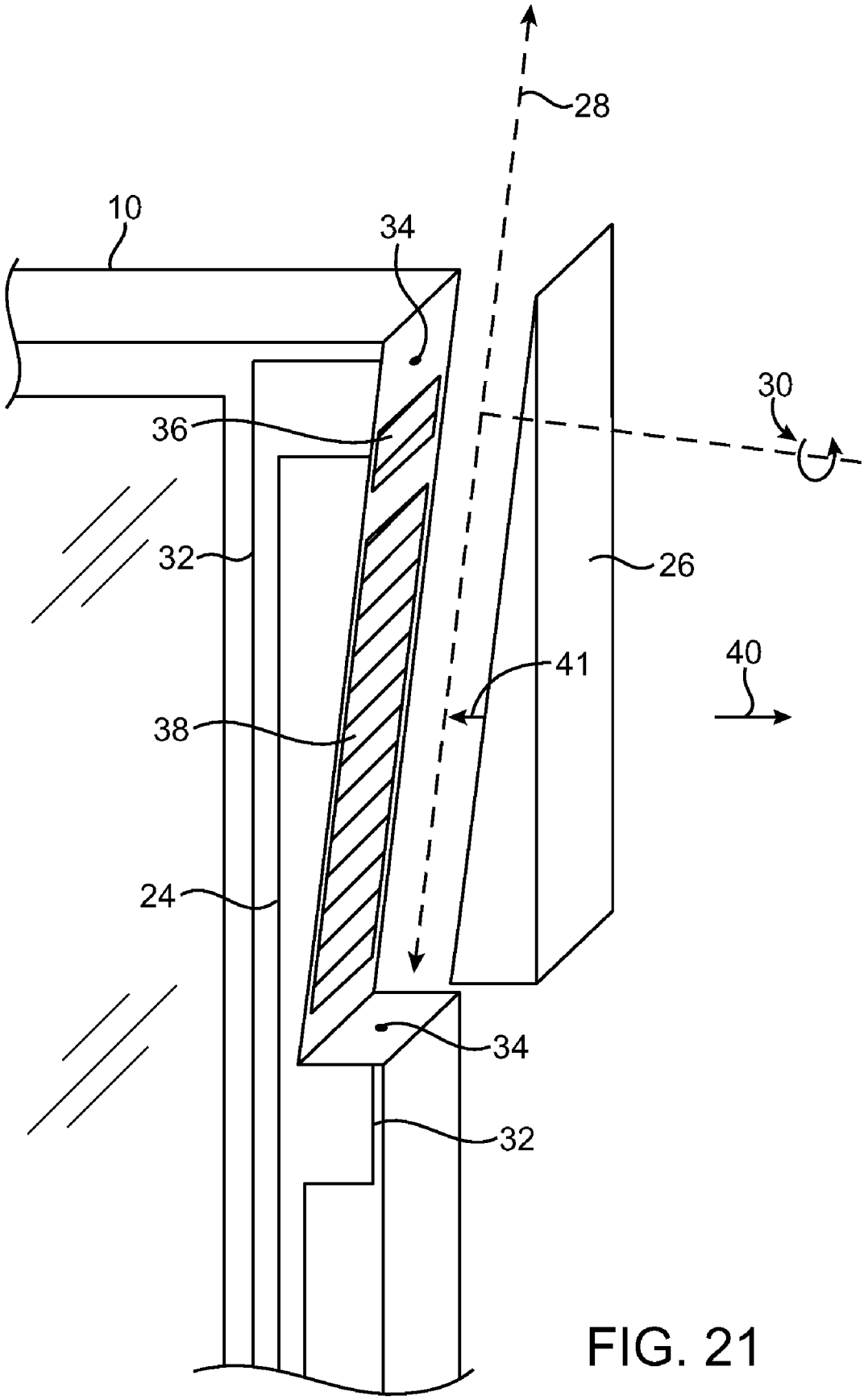
FIG. 21 is an exploded perspective view of an illustrative electronic device and an illustrative extendable, removable antenna in accordance with an embodiment of the present invention.
Figure 22:
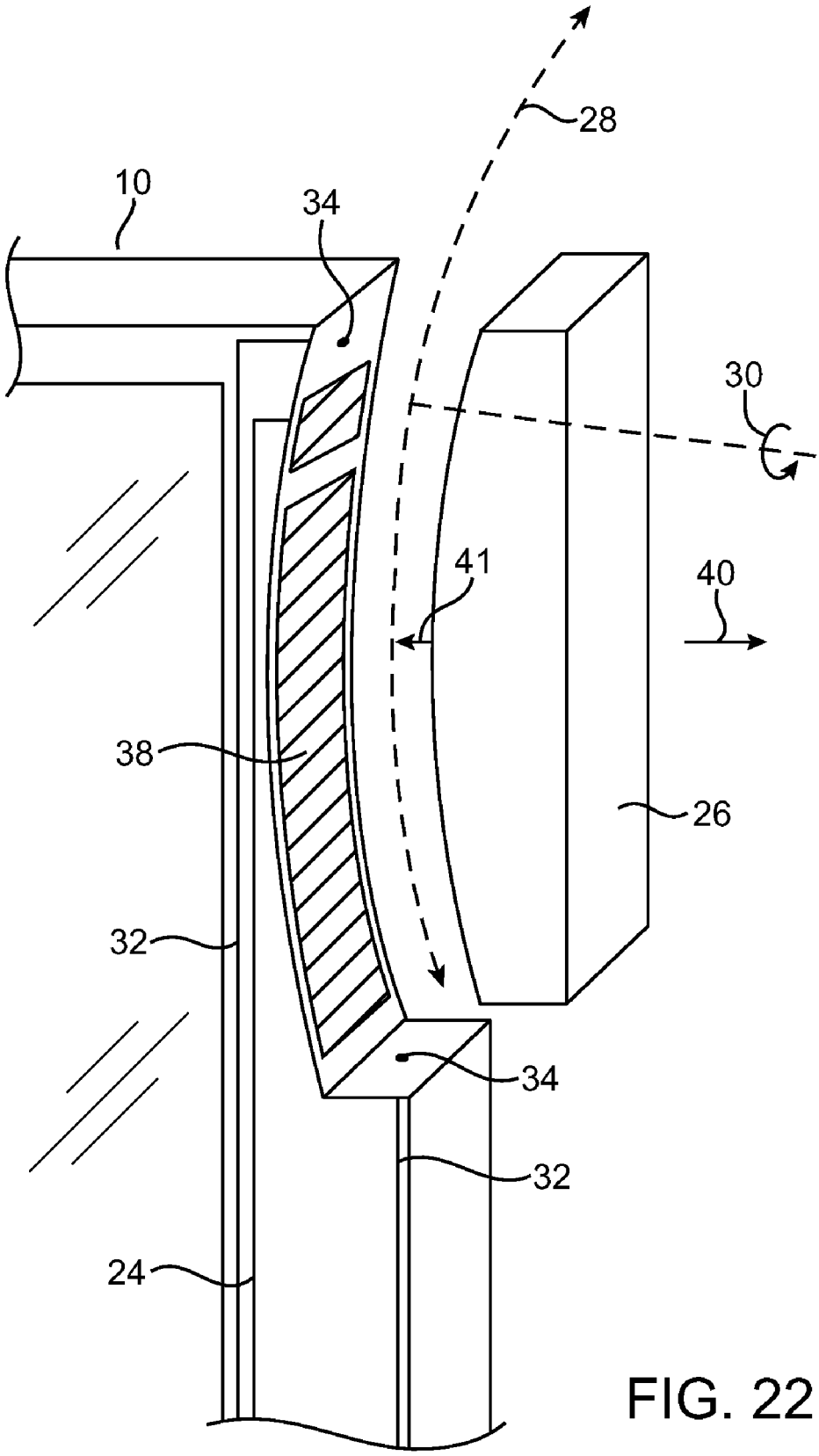
FIG. 22 is an exploded perspective view of an illustrative electronic device and an illustrative extendable, removable antenna in accordance with an embodiment of the present invention.

As shown in FIGS. 21 and 22, the antenna structure (e.g., structure 26) of FIG. 4 does not have to be square.

As illustrated by FIG. 21, antenna structure 26 and device 10 may have corresponding tapered portions. The taper of antenna 26 and device 10 may help to increase the separation between an antenna resonating element in antenna 26 and a ground plane which may be formed from portions of device 10. For example, as antenna structure 26 extenda by reciprocating longitudinally along line 28 or by rotating around axis 30, antenna structure 26 may move away from device 10 at an angle. By extending at an angle, antenna 26 may have increased separation from device 10 as compared to the square antenna structure illustrated in FIG. 4.

As illustrated by FIG. 22, antenna structure 26 and device 10 may have corresponding curved portions that increase the separation between antenna 26 and device 10 when the antenna is in its extended position. For example, when antenna 26 is in its extended position, antenna 26 may extend from device 10 at an angle (e.g. rather than extending in a simple vertical manner).

The foregoing is merely illustrative of the principles of this invention and various modifications can be made by those skilled in the art without departing from the scope and spirit of the invention.

What is claimed is:

1. Apparatus comprising:

an electronic device having a first magnetic coupling structure; and a removable antenna that is removable during operation of the electronic device, that has a second magnetic coupling structure that is coupled to the first magnetic coupling structure, and that has an antenna resonating element, wherein at least one of the first and second magnetic coupling structures comprises a magnet, wherein the removable antenna is configured to rotate into an extended position, and wherein the first and second magnetic coupling structures hold the removable antenna in the extended position and are configured to allow the removable antenna to be accidently dislodged from the electronic device without damage.

2. The apparatus defined in claim 1 wherein the electronic device comprises a computer.

3. The apparatus defined in claim 1 wherein the electronic device further comprises transceiver circuitry that generates and receives radio-frequency signals over a communications path.

4. The apparatus defined in claim 3 wherein the first and second magnetic coupling structures are configured to electrically couple the antenna resonating element to the communications path so that the radio-frequency signals pass between the antenna resonating element and the transceiver circuitry.

5. The apparatus defined in claim 1 wherein the removable antenna further comprises a first magnetic attraction element, wherein the electronic device further comprises a second magnetic attraction element, and wherein the first and second magnetic attraction elements are configured to help secure the removable antenna to the electronic device when the removable antenna is in a stowed position.

6. The apparatus defined in claim 1 wherein the removable antenna is configured to rotate between a stowed position and the extended position.

7. The apparatus defined in claim 6 wherein the first and the second magnetic coupling structures are configured to limit non-rotational movement between the removable antenna and an antenna receptacle in the electronic device.

8. The apparatus defined in claim 7 wherein the first magnetic coupling structure comprises a cylindrical protrusion, wherein the second magnetic coupling structure comprises a corresponding cylindrical cavity.

9. Apparatus comprising:

an electronic device having a first springless coupling structure and having a radio-frequency transceiver;

a communications path that conveys radio-frequency signals between the radio-frequency transceiver and the first springless coupling structure; and a removable antenna having a second springless coupling structure that is removably coupled to the first springless coupling structure and that has an antenna resonating element, wherein at least one of the first and second springless coupling structures comprises a magnet, and wherein the antenna resonating element is electrically coupled to the communications path through the first and second springless coupling structures so that the radio frequency signals are conveyed between the radio-frequency transceiver and the antenna resonating element over the communications path and through the first and second springless coupling structures.

10. The apparatus defined in claim 9 wherein the removable antenna has a longitudinal axis, wherein the removable antenna is configured to reciprocate along its longitudinal axis, and wherein the removable antenna is configured to reciprocate between a stowed position and an extended position.

11. The apparatus defined in claim 10 wherein the first and second springless coupling structures are configured to break the electrical coupling between the antenna resonating element and the radio-frequency signals carried on the communications path when the removable antenna reciprocates away from the extended position.

12. The apparatus defined in claim 10 wherein the electronic device further comprises a first magnetic attraction element, wherein the removable antenna further comprises a second magnetic attraction element, and wherein the first and the second magnetic attraction elements are configured to guide the removable antenna along its longitudinal axis as the removable antenna reciprocates between the stowed position and the extended position.

13. The apparatus defined in claim 12 wherein the electronic device has portions defining an antenna receptacle, wherein the first and the second magnetic attraction elements and the first and second springless coupling structures are configured to attract the removable antenna to the antenna receptacle, and wherein the removable antenna and the antenna receptacle are configured so that the removable antenna is removable without damaging the removable antenna.

14. The apparatus defined in claim 9 wherein the first springless coupling structure further comprises a ball, wherein the second springless coupling structure further comprises a detent structure that is configured to couple with the ball, and wherein the ball is attracted to the detent structure by a magnetic attraction force between the ball and the detent structure.

15. The apparatus defined in claim 14 wherein the electronic device comprises a portable computer.

16. Apparatus comprising:

an electronic device having a first coupling structure and having a radio-frequency transceiver;

a communications path that conveys radio-frequency signals between the radio-frequency transceiver and the first coupling structure; and an unextendable removable antenna having a second coupling structure that is coupled to the first coupling structure and having an antenna resonating element, wherein at least one of the first and second coupling structures comprises a magnet, and wherein the antenna resonating element is electrically coupled to the communications path through the first and second coupling structures so that the radio frequency signals are conveyed between the radio-frequency transceiver and the antenna resonating element over the communications path and through the first and second coupling structures.

17. The apparatus defined in claim 16 wherein the first and second coupling structures are configured so that the unextendable removable antenna is removable without damaging the unextendable removable antenna and wherein the electronic device comprises a portable computer.

18. A method of using a removable antenna in an electronic device having a springless antenna receptacle and transceiver circuitry, comprising:

when the removable antenna is in the springless antenna receptacle, magnetically coupling the removable antenna to the springless antenna receptacle, wherein the removable antenna is magnetically coupled to the springless antenna receptacle such that the removable antenna can be accidently dislodged from the electronic device without damage;

with the transceiver circuitry, generating and receiving radio-frequency signals over a communications path;

electrically coupling the removable antenna to the transceiver circuitry by electrically coupling an antenna resonating element in the removable antenna to the communications path; and with the removable antenna, transmitting and receiving the radio-frequency signals with the antenna resonating element.

19. The method defined in claim 18 wherein electrically coupling the removable antenna to the transceiver circuitry further comprises electrically coupling the antenna resonating element in the removable antenna to the communications path with a first magnetic coupling structure in the removable antenna and a second magnetic coupling structure in the springless antenna receptacle.

20. The method defined in claim 18 wherein the removable antenna has a first magnetic attraction element, wherein the springless antenna receptacle has a second magnetic attraction element, wherein the first and second magnetic attraction elements comprise at least one electrically conductive material, and wherein electrically coupling the removable antenna to the transceiver circuitry further comprises electrically coupling the antenna resonating element in the removable antenna to the communications path through the electrically conductive material of the first and second magnetic attraction elements.

* * * * *

UNITED STATES PATENT AND TRADEMARK OFFICE

CERTIFICATE OF CORRECTION

PATENT NO. : 7,880,678 B2
APPLICATION NO. : 12/061176
DATED : February 1, 2011
INVENTOR(S) : Brett William Degner et al.

It is certified that error appears in the above-identified patent and that said Letters Patent is hereby corrected as shown below:

In column 18, line 53, delete "Wi-Fi" and insert -- Wi-Fi® --, therefor.

In column 19, line 38, delete "extenda" and insert -- extendable --, therefor.

Signed and Sealed this
Fifteenth Day of November, 2011

David J. Kappos

David J. Kappos
*Director of the United States Patent and Trademark Office*